US012038002B2

(12) United States Patent
Noh et al.

(10) Patent No.: US 12,038,002 B2
(45) Date of Patent: Jul. 16, 2024

(54) ROTARY COMPRESSOR

(71) Applicant: LG ELECTRONICS INC., Seoul (KR)

(72) Inventors: Kiyoul Noh, Seoul (KR); Yongkyu Choi, Seoul (KR); Minho Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/196,028

(22) Filed: May 11, 2023

(65) Prior Publication Data

US 2023/0366398 A1 Nov. 16, 2023

(30) Foreign Application Priority Data

May 16, 2022 (KR) ..... 10-2022-0059664

(51) Int. Cl.
*F04C 18/00* (2006.01)
*F04C 15/00* (2006.01)
(Continued)

(52) U.S. Cl.
CPC ..... *F04C 15/0057* (2013.01); *F04C 15/0088* (2013.01); *F04C 18/3441* (2013.01);
(Continued)

(58) Field of Classification Search
CPC F04C 18/344; F04C 18/3441; F04C 18/3564; F04C 15/0057; F04C 15/0088;
(Continued)

(56) References Cited

U.S. PATENT DOCUMENTS 4,636,154 A * 1/1987 Sugiyama ..... F04C 29/02 418/97
2012/0085118 A1* 4/2012 Yokoyama ..... F04C 18/3564 418/11

FOREIGN PATENT DOCUMENTS

JP 01-318788 12/1989
JP 63106390 A * 5/1998 ..... F04C 29/023
(Continued)

OTHER PUBLICATIONS

JP63106390A—Kosokabe et al.—Rotor Type Sealed Compressor—May 11, 1988—Abstract (Year: 1988).*

*Primary Examiner* — Theresa Trieu
(74) *Attorney, Agent, or Firm* — KED & ASSOCIATES

(57) ABSTRACT

A rotary compressor is provided that may include a casing, a cylinder having an inner circumferential surface in an annular shape, a roller rotatably disposed in a compression space of the cylinder, a rotational shaft coupled to an inner circumference of the roller, main and sub bearings defining surfaces of the compression space, and a sub bearing cover coupled to the sub bearing to cover one end of the sub bearing and defining a discharge chamber with the sub bearing to communicate with the compression space so as to accommodate compressed refrigerant to be discharged. The sub bearing or the sub bearing cover may include a first barrier rib that protrudes from a surface thereof located inside of the discharge chamber. The first barrier rib may be spaced apart from a surface opposite to the surface within the discharge chamber by a predetermined distance.

20 Claims, 11 Drawing Sheets

(51) Int. Cl.

| | |
|---|---|
| ***F04C 18/344*** | (2006.01) |
| ***F04C 27/00*** | (2006.01) |
| ***F04C 29/02*** | (2006.01) |
| ***F04C 29/12*** | (2006.01) |

(52) U.S. Cl.
CPC ..... *F04C 27/001* (2013.01); *F04C 29/12* (2013.01); *F04C 2240/30* (2013.01)

(58) Field of Classification Search
CPC ..... F04C 27/001; F04C 29/045; F04C 29/12; F04C 2240/10; F04C 2240/20; F04C 2240/30; F04C 2240/50; F04C 2240/60
See application file for complete search history.

(56) References Cited

FOREIGN PATENT DOCUMENTS

| | | |
|---|---|---|
| JP | 2015-137576 | 7/2015 |
| KR | 10-2004-0017801 | 2/2004 |
| WO | WO 2013/175566 | 11/2013 |

* cited by examiner

ROTARY COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2022-0059664, filed in Korea on May 16, 2022, the contents of which are incorporated by reference herein in their entirety.

BACKGROUND

1. Field

A rotary compressor is disclosed herein.

2. Background

Compressors may be classified into a reciprocal compressor, a rotary compressor, and a scroll compressor according to a method of compressing a refrigerant. A reciprocal compressor is configured such that a compression space is formed between a piston and a cylinder and a fluid is compressed while the piston performs a linear motion. A rotary compressor is configured to compress a fluid by a roller which is eccentrically rotated inside of a cylinder, and a scroll compressor is configured to compress a fluid as a pair of scrolls formed in a spiral shape are rotated in an engaged state with each other.

Among others, rotary compressors may be classified according to a way that a roller rotates relative to a cylinder. For example, rotary compressors may be classified into an eccentric rotary compressor in which a roller rotates eccentrically with respect to a cylinder, and a concentric rotary compressor in which a roller rotates concentrically with respect to a cylinder.

Also, rotary compressors may be classified according to a method for dividing a compression space. For example, rotary compressors may be classified into a vane rotary compressor in which a vane is brought into contact with a roller or a cylinder to divide a compression space, and an elliptical rotary compressor in which a portion of an elliptical roller is brought into contact with a cylinder to divide a compression space.

The rotary compressor includes a drive motor. A rotational shaft is coupled to a rotor of the drive motor and transmits a rotational force of the drive motor to a roller through the rotational shaft, so as to compress refrigerant.

Korean Patent Publication No. 10-2004-0017801 (hereinafter "Patent Document 1"), which is hereby incorporated by reference, discloses a compressor using a shell having a high-pressure side oil sump and a low-pressure side motor. In the compressor, an inside of the shell is divided into a mechanism portion, a high-pressure portion, and a low-pressure portion, and the high-pressure portion and the low-pressure portion are separated by a seal. In Patent Document 1, a location of the seal can be applied to an upper/lower bearing or a cylinder. In addition, refrigerant gas is transferred from a low-pressure space to a compression chamber through an intake orifice, and compressed gas exhausts from a compression unit to a baffle space. A disk is installed at a front of a discharge port of a baffle to centrifugate discharge gas and oil such that the oil is returned to the oil sump. Final discharge gas is discharged to outside through a discharge tube. In the compressor of Patent Document 1, as the discharge port of the baffle and the discharge tube are close to the oil sump, this structure interferes with the discharge at the beginning of operation or when an oil level rises under specific operating conditions.

Japanese Patent Publication No. 1989-318788 (hereinafter "Patent Document 2"), which is hereby incorporated by reference, discloses a low-pressure rotary compressor. In the rotary compressor, a motor unit is installed at an upper portion and a compressor unit is installed at a lower portion inside of a hermetic case, a main bearing is disposed at an upper portion of the compressor unit, a crank shaft is inserted through the main bearing, and all or a portion of the main bearing is located below an oil level of refrigeration oil. The compressor of Patent Document 2 has a problem of interfering with suction at the beginning of operation or when the oil level rises under specific operating conditions.

PCT Patent Publication No. WO2013-175566 (hereinafter "Patent Document 3"), which is hereby incorporated by reference, discloses a refrigerant compressor. The refrigerant compressor includes a hermetic container, a compression mechanism portion accommodated in the hermetic container to suction refrigerant into the hermetic container and compress the refrigerant inside of the hermetic container, a motor accommodated in the hermetic container to operate the compression mechanism portion, a suction tube that suctions refrigerant into the hermetic container, a cover disposed to face an outlet of the suction tube and allow refrigerant suctioned through the suction tube to collide therewith to be separated into gas refrigerant and liquid refrigerant so that the liquid refrigerant is dropped on a wire of the motor, and a suction passage through which the separated gas refrigerant is guided to an inlet of a compression chamber located in the compression mechanism portion. The refrigerant compressor of Patent Document 3 has a problem in that suction loss is increased and an additional structure for oil return must be applied.

Japanese Patent Publication No. 2015-137576 (hereinafter "Patent Document 4"), which is hereby incorporated by reference, discloses a compressor capable of suppressing chattering of vanes under low compression ratio conditions and simultaneously suppressing a power increase due to generation of excessive back pressure in vanes. Further, Patent Document 4 discloses a horizontal type compressor, a high/low pressure separation structure, an oil supply through differential pressure, and forming of the differential pressure behind the vane as an intermediate pressure. Patent Document 4 has a problem that a separate device for oil return, for example, a valve, must be applied.

On the other hand, in the case of a vane compressor employing a high-pressure structure in which refrigerant is directly suctioned from outside of the compressor into a cylinder, a vulnerable portion in reliability, such as a portion where a vane is tilted when liquid refrigerant flows in, is generated and an operating area is limited depending on a temperature or a motor. In the case of a vane compressor employing a low-pressure structure in which refrigerant flows into a casing and then is introduced into a cylinder, it has advantages in terms of reliability, motor temperature, and noise characteristics, compared to the high-pressure structure, but has a problem of a high oil circulation rate.

Therefore, it is required to develop a rotary compressor having a structure capable of reducing an oil circulation rate while employing a low-pressure structure. It is also required to develop a rotary compressor having a structure capable of allowing a smooth oil return without employing a separate valve or the like for oil return.

BRIEF DESCRIPTION OF THE DRAWINGS

Embodiments will be described in detail with reference to the following drawings in which like reference numerals refer to like elements, and wherein.

DETAILED DESCRIPTION

For the sake of brief description with reference to the drawings, the same or equivalent components may be provided with the same or similar reference numbers, and description thereof will not be repeated.

In addition, a structure that is applied to one embodiment will be equally applied to another embodiment as long as there is no structural and functional contradiction in the different embodiments.

A singular representation may include a plural representation unless it represents a definitely different meaning from the context.

Hereinafter, if a detailed explanation for a related known function or construction is considered to unnecessarily divert the gist, such explanation has been omitted but would be understood by those skilled in the art.

The accompanying drawings are used to help easily understand the technical idea and it should be understood that the idea is not limited by the accompanying drawings. The idea should be construed to extend to any alterations, equivalents, and substitutes besides the accompanying drawings.

Figure 1:
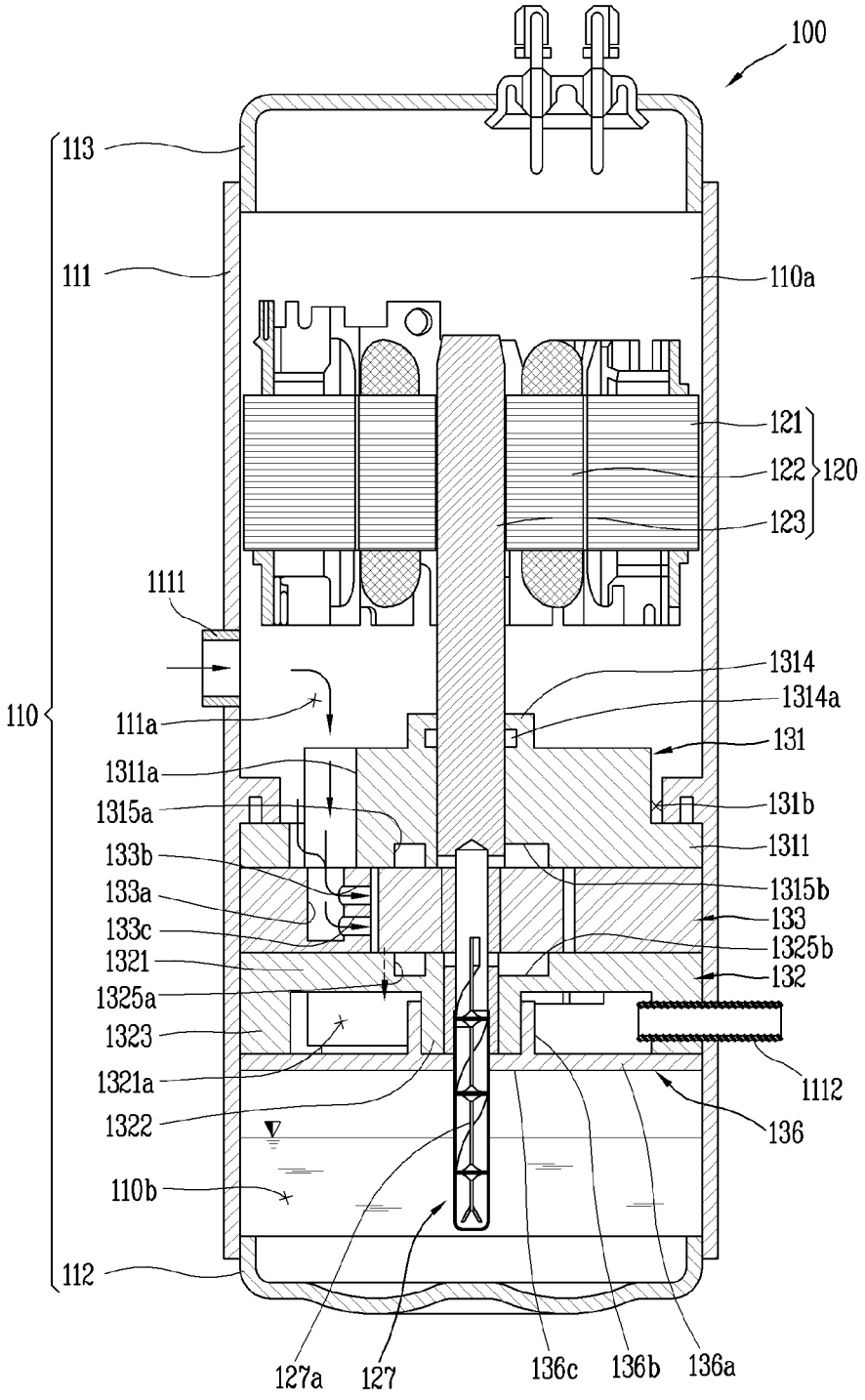
FIG. 1 is a longitudinal cross-sectional view of a rotary compressor according to an embodiment.
Figure 2:
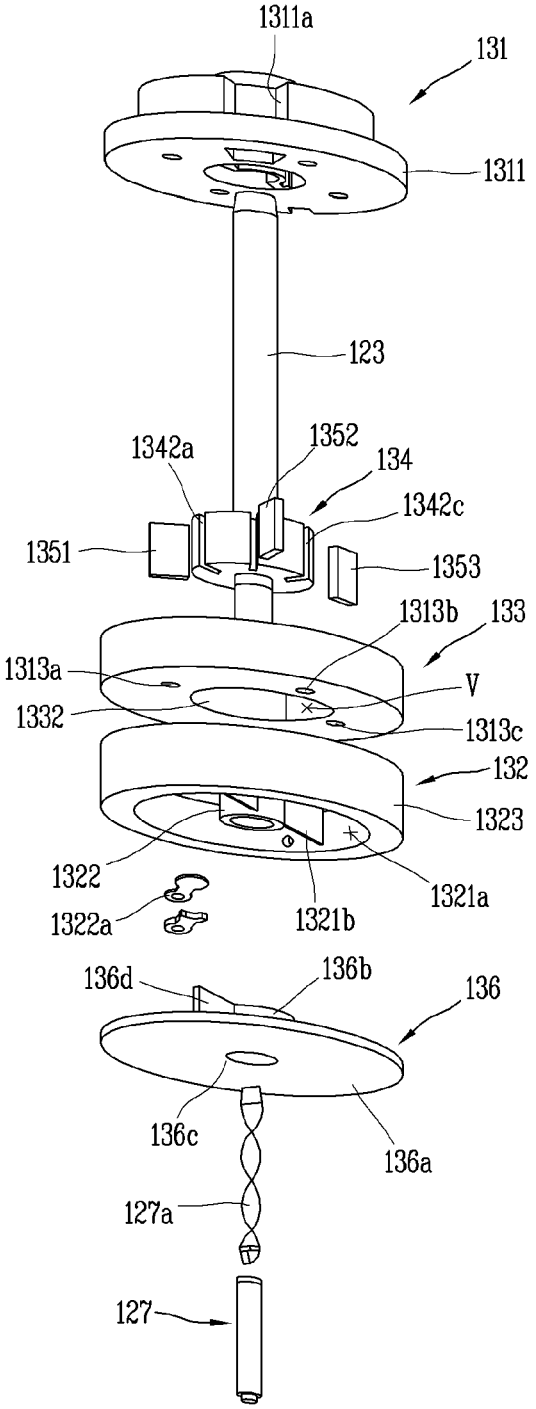
FIG. 2 is an exploded perspective view of a compression unit of the rotary compressor according to an embodiment.
Figure 3:
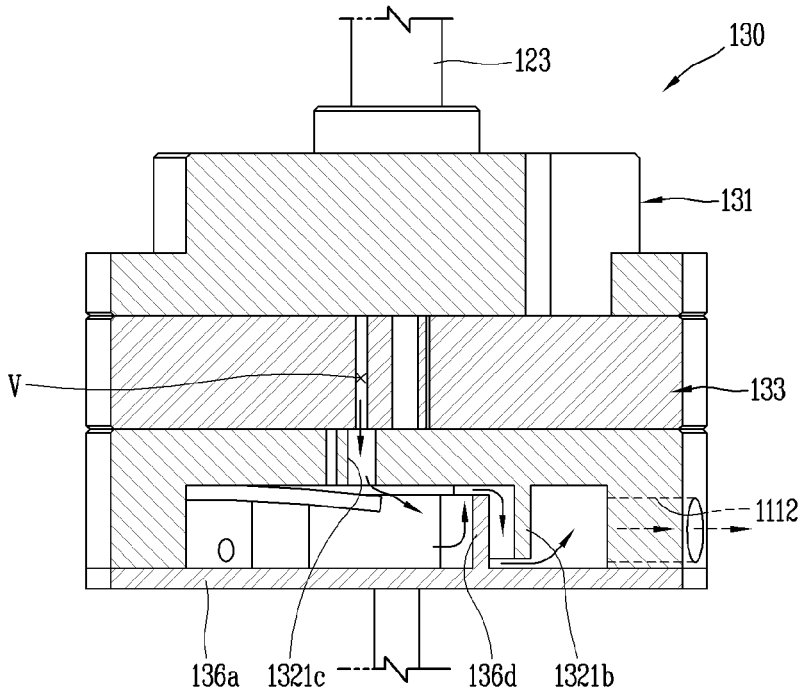
FIG. 3 is a longitudinal cross-sectional view of the compression unit of the rotary compressor according to an embodiment.

FIG. 1 is a longitudinal cross-sectional view of a rotary compressor according to an embodiment. FIG. 2 is an exploded perspective view of a compression unit of the rotary compressor according to an embodiment. FIG. 3 is a longitudinal cross-sectional view of the compression unit of the rotary compressor according to an embodiment.

Hereinafter, rotary compressor 100 according to an embodiment will be described with reference to FIGS. 1 to 3.

The rotary compressor 100 according to an embodiment may be a vane rotary compressor 100. The rotary compressor 100 according to an embodiment may include a casing 110, a cylinder 133, a roller 134, a rotational shaft 123, a main bearing 131, a sub bearing 132, and a sub bearing cover 136.

The casing 110 defines an appearance of the compressor. The cylinder 133 may be installed in the casing 110 and have an inner circumferential surface formed in an annular shape to define a compression space V.

The roller 134 may be rotatably disposed in the compression space V of the cylinder 133. For example, vanes may be slidably inserted into vane slots 1342*a*, 1342*b*, and 1342*c* disposed at preset or predetermined intervals along an outer circumferential surface of the roller 134. In this case, the embodiment may be a concentric rotary compressor. However, embodiments are not limited thereto, and may be another type of rotary compressor in which vanes are slidably inserted into an inner circumference of a cylinder.

The rotational shaft 123 may be coupled to an inner circumference of the roller 134 to apply a rotational force to the roller 134. The main bearing 131 and the sub bearing 132 may be respectively disposed on both ends of the cylinder 133 and coupled to an outer circumference of the rotational shaft 123. The main bearing 131 and the sub bearing 132 may be spaced apart from each other to define both surfaces of the compression space V.

The sub bearing 132 may include a discharge chamber 1321*a* that communicates with the compression space V and accommodates compressed refrigerant to be discharged. The sub bearing cover 136 may be coupled to the sub bearing 132 to cover one end of the sub bearing 132 and defines the discharge chamber 1321*a* with the sub bearing 132 to communicate with the compression space so as to accommodate compressed refrigerant to be discharged.

The sub bearing 132 or the sub bearing cover 136 may include a first barrier rib 136*d* that protrudes from a surface thereof located inside of the discharge chamber 1321*a*. The first barrier rib 136*d* may be spaced apart from a surface opposite to the surface within the discharge chamber 1321*a* by a predetermined distance. The first barrier rib 136*d* may be disposed on the sub bearing cover 136.

The sub bearing 132 may include a second barrier rib 1321*b* that protrudes from a surface thereof opposite to the surface where the first barrier rib 136*d* is disposed within the discharge chamber 1321*a*. The second barrier rib 1321*b* may be spaced apart from the sub bearing cover 136 by a predetermined distance.

Referring to FIGS. 2 and 3, the sub bearing 132 may include the second barrier rib 1321*b*, and the second barrier rib 1321*b* may protrude from a surface of the sub bearing 132 located within the discharge chamber 1321*a*. In addition, the second barrier rib 1321*b* may be spaced apart from a surface opposite to the surface of the sub bearing 132 by a predetermined distance. As the second barrier rib 1321*b* is disposed in the discharge chamber 1321*a* of the sub bearing 132, the flow of oil may be restricted by the second barrier rib 1321*b* when the discharge chamber 1321*a* is defined as a small space, thereby suppressing or preventing the oil from being discharged outward together with refrigerant and facilitating an oil return.

The sub bearing 132 may be formed such that one end thereof is open. The rotary compressor 100 according to an embodiment may further include the sub bearing cover 136 coupled to cover the open end of the sub bearing 132 to define the discharge chamber 1321*a*.

The sub bearing cover 136 may include the first barrier rib 136*d* that protrudes from the surface of the sub bearing cover 136 located within the discharge chamber 1321*a*. The first barrier rib 136*d* may be spaced a predetermined distance apart from the surface of the sub bearing 132.

The second barrier rib 1321*b* and the first barrier rib 136*d* may form a symmetrical structure on different surfaces. This may secure a longer length of a passage along which refrigerant and oil flow within the discharge chamber 1321*a*, and allow refrigerant separated from oil to be discharged by the first and second barrier ribs 1321*b* and 136*d*. More specifically, as illustrated in FIG. 3, while refrigerant and oil pass between the first barrier rib 136*d* and an upper surface of the discharge chamber 1321*a*, the oil blocked by the first barrier rib 136*d* may be partially separated from the refrigerant and pass through the first barrier rib 136*d*. Thereafter, while passing through the second barrier rib 1321*b* and a surface of the sub bearing cover 136, namely, a lower surface of the discharge chamber 1321*a*, the oil is secondarily separated from the refrigerant.

The sub bearing 132 may have a sub inlet hole formed through one or a first side thereof between the compression space V and the discharge chamber 1321*a*, and a discharge tube 1112 disposed through another or a second side thereof such that the compressed refrigerant may be discharged to the outside. The first and second barrier ribs 1321*b* and 136*d* may be disposed between the first side and the second side.

FIG. 3 illustrates an example in which a sub inlet hole 1321*c* is formed through the sub bearing 132 at a portion in a vicinity of an upper center of the discharge chamber 1321*a* and the discharge tube 1112 is installed through a right end of the discharge chamber 1321*a*. The first and second barrier ribs 1321*b* and 136*d* are disposed between the sub inlet hole 1321*c* and the discharge tube 1112. According to this structure, as a length of a passage along which refrigerant and oil flow is increased by the first and second barrier ribs 1321*b* and 136*d*, the oil is separated two times.

Figure 4A:
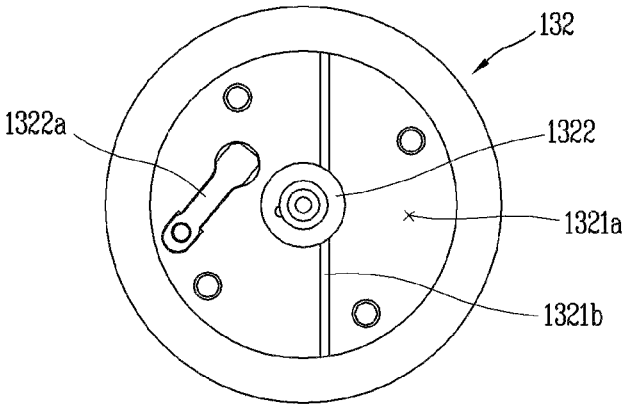
FIG. 4A is a plan view illustrating an inside of a sub bearing.

On the other hand, FIG. 4A illustrates an example in which the second barrier rib 1321*b* is configured to come into contact with two points on an inner circumferential surface of the sub bearing 132. In addition, although not clearly illustrated in FIG. 4B, the first barrier rib 136*d* may be configured to come into contact with the two points on the inner circumferential surface of the sub bearing 132 when the sub bearing cover 136 is coupled to the sub bearing 132. With this structure, the first and second barrier ribs 1321*b* and 136*d* form a structure of being spaced apart from only an upper or lower surface of the discharge chamber 1321*a*, which may be advantageous in separating oil from refrigerant.

Hereinafter, configurations of the cylinder 133 and the roller 134 will be described with reference to FIG. 2.

The cylinder 133 may have an inner circumferential surface formed in an annular shape to define a compression space V. Also, the cylinder 133 may have a suction passage for refrigerant. The suction passage may include a suction hole 133*a* and first and second communication holes 133*b* and 133*c*.

The suction hole 133*a* allows refrigerant introduced into the compressor to be suctioned into the cylinder 133. The suction hole 133*a* communicates with the compression space V so that refrigerant is suctioned in and supplied to the compression space V through the first and second communication holes 133*b* and 133*c*.

The refrigerant suctioned into the suction hole 133*a* may be refrigerant gas. The refrigerant gas separated from liquid refrigerant through an accumulator may be introduced into the compression space V through the suction hole 133*a* of the cylinder 133, and the liquid refrigerant may be introduced back into an evaporator.

Figure 5A:
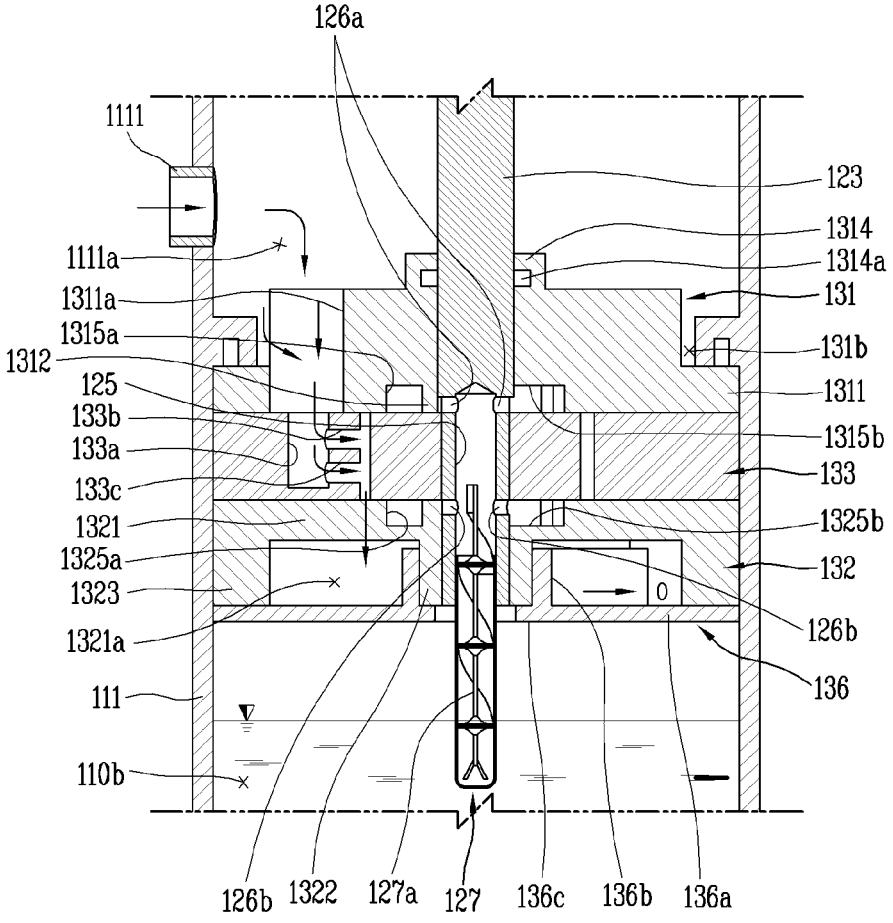
FIG. 5A is a longitudinal cross-sectional view of the compression unit of the rotary compressor according to an embodiment.

The cylinder 133 may include the first and second communication holes 133*b* and 133*c* that communicate with the suction hole 133*a*. The first and second communication holes 133*b* and 133*c* may be spaced apart from each other in a vertical direction as illustrated in FIG. 5A.

In addition, the first and second communication holes 133*b* and 133*c* may provide communication with each other between the suction hole 133*a* and the compression space V. As illustrated in FIG. 5A, an example in which the first and second communication holes 133*b* and 133*c* are parallel to each other and extend in a lateral direction is shown; however, embodiments are not limited thereto. Thus, the first and second communication holes 133*b* and 133*c* may be inclined at a predetermined angle in consideration of a flow loss minimization, and a suction efficiency, for example.

The refrigerant introduced into the compressor may flow into the compression space V via the suction hole 133*a* and the first and second communication holes 133*b* and 133*c*. In particular, refrigerant introduced into the compressor through the suction hole 133*a* passes through the first and second communication holes 133*b* and 133*c*, that is, the two communication holes 133*b* and 133*c*. Therefore, as compared to a case of being introduced through a single compression hole, less refrigerant in a liquid state is introduced and almost the same amount of refrigerant in a gaseous state is introduced because a suction time is secured, thereby adjusting a flow rate of refrigerant introduced.

An inner circumferential surface 1332 of the cylinder 133 may be formed in an elliptical shape. The inner circumferential surface 1332 of the cylinder 133 according to an embodiment may be formed in an asymmetrical elliptical shape by combining a plurality of ellipses, for example, four ellipses having different aspect ratios to have two origins. The shape of the inner circumferential surface of the cylinder 133 will be described hereinafter.

The roller 134 may be rotatably disposed in the compression space V of the cylinder 133. The roller 134 may include a plurality of vane slots 1342*a*, 1342*b*, and 1342*c* disposed on an outer circumferential surface thereof at preset or predetermined distances. In addition, the compression space V may be defined between an inner circumference of the cylinder 133 and an outer circumference of the roller 134.

That is, the compression space V may be a space defined between an inner circumferential surface of the cylinder 133 and an outer circumferential surface of the roller 134. In addition, the compression space V may be divided by the plurality of vanes 1351, 1352, and 1353 into as many spaces as the number of vanes 1351, 1352, and 1353.

For example, referring to FIG. 3, the compression space V may be divided by three vanes 1351, 1352, and 1353 into a first compression space disposed adjacent to a discharge port 1313*a*, 1313*b*, 1313*c*, a second compression space disposed adjacent to a suction port 1311*a* and a third compression space disposed between the suction port 1311*a* and the discharge port 1313*a*, 1313*b*, 1313*c*. The vanes 1351, 1352, and 1353 may be slidably inserted into the vane slots 1342*a*, 1342*b*, and 1342*c*, and rotate together with the roller 134. In addition, back pressure may be applied to a rear end of the vane 1351, 1352, 1353 inserted inside of the roller 134 so that an opposite front end surface of the vane 1351, 1352, 1353 is brought into contact with the inner circumference of the cylinder 133.

The vane 1351, 1352, 1353 may be provided as a plurality to constitute a multi-back pressure structure, and the front end surfaces of the plurality of vanes 1351, 1352, and 1353 may be brought into contact with the inner circumference of the cylinder 133 to partition the compression space V into a plurality of compression spaces V. An example in which three vanes 1351, 1352, and 1353 are provided is illustrated in FIG. 3, and thus, the compression space V may be divided into three compression spaces V between the adjacent vanes of the three vanes 1351, 1352, and 1353.

Hereinafter, the rotary compressor 100 according to an embodiment will be further described.

Referring to FIG. 1, the rotary compressor 100 according to an embodiment may further include a drive motor 120 installed inside of the casing 110 to generate a rotational power. The drive motor 120 may be installed in an upper inner space 110*a* of the casing 110, and the compression unit 130 may be installed in a lower inner space 110*a* of the casing 110. The drive motor 120 and the compression unit 130 may be connected through the rotational shaft 123.

The casing 110 that defines an outer appearance of the compressor may be classified as a vertical type and a horizontal type according to a compressor installation method. As for the vertical type casing, the drive motor 120 and the compression unit 130 are disposed at upper and lower sides in an axial direction, respectively. As for the horizontal type casing, the drive motor 120 and the compression unit 130 are disposed at left and right or lateral sides, respectively. In this embodiment, the casing 110 is described as a vertical type, but embodiments may be applied to a horizontal type as well.

In addition, the casing 110 may include a suction tube 1111 coupled to the casing 110 to allow refrigerant to flow to inside thereof, and the discharge tube 1112 that communicates with the discharge chamber 1321*a* to allow compressed refrigerant to be discharged to outside. The discharge tube 1112 may be located lower than the suction tube 1111.

The casing 110 may include an intermediate shell 111 having a cylindrical shape, a lower shell 112 that covers a lower end of the intermediate shell 111, and an upper shell 113 that covers an upper end of the intermediate shell 111. The drive motor 120 and the compression unit 130 may be fixedly inserted into the intermediate shell 111. In addition, the suction tube 1111 may be disposed through the intermediate shell 111. FIG. 1 shows an example in which the suction tube 1111 is installed through the intermediate shell 111 between the drive motor 120 and the compression unit.

As such, the rotary compressor 100 according to an embodiment may be a low-pressure type in which refrigerant introduced into the casing 110 flows into the compression space of the cylinder 133 via the casing 110.

The lower shell 112 may be coupled to a lower end of the intermediate shell 111 in a sealing manner, and an oil storage space 110*b* in which oil to be supplied to the compression unit 130 is stored may be formed below the compression unit 130. The upper shell 113 may be coupled to seal an upper end of the intermediate shell 111.

The drive motor 120 that constitutes a motor unit supplies power to cause the compression unit 130 to be driven. The drive motor 120 may include a stator 121, a rotor 122, and rotational shaft 123.

The stator 121 may be fixedly inserted into the casing 110. The stator 121 may be fixed to an inner circumferential surface of the casing 110 in, for example, a shrink-fitting manner. For example, the stator 121 may be press-fitted into an inner circumferential surface of the intermediate shell 111.

The rotor 122 may be rotatably inserted into the stator 121. The rotational shaft 123 may be press-fitted into a center of the rotor 122. Accordingly, the rotational shaft 123 may rotate concentrically together with the rotor 122.

An oil passage 125 having a hollow hole shape may be formed in a central portion of the rotational shaft 123, and oil passage holes 126*a* and 126*b* may be formed through a middle portion of the oil passage 125 toward an outer circumferential surface of the rotational shaft 123. The oil passage holes 126*a* and 126*b* may include first oil passage hole 126*a* belonging to a range of a main bush portion 1312 described hereinafter and a second oil passage hole 126*b* belonging to a range of a second bearing portion. Each of the first oil passage hole 126*a* and the second oil passage hole 126*b* may be provided as one or as a plurality. In this embodiment, each of the first and second oil passage holes is provided as a plurality. An oil passage 125 may be formed from a lower portion of the rotational shaft 123 to a lower portion of the main bearing 131.

An oil pickup 127 may be installed at a middle or lower end of the oil passage 125. For example, the oil pickup 127 may include one of a gear pump, a viscous pump, or a centrifugal pump. This embodiment illustrates a case in which the centrifugal pump is employed. Accordingly, when the rotational shaft 123 rotates, oil filled in the oil storage space 110*b* is pumped by the oil pickup 127 and is suctioned along the oil passage 125, so as to be introduced to a sub bearing surface of the sub bush portion 1322 through the second oil passage hole 126*b* and to a main bearing surface of the main bush portion 1312 through the first oil passage hole 126*a*. The oil pickup 127 may include a propeller 127*a* that is rotated to suction oil.

In addition, the rotational shaft 123 may be integrally formed with the roller 134 or the roller 134 may be press-fitted to the rotational shaft 123.

The rotational shaft 123 may include a main shaft portion press-fitted to an upper-half portion thereof based on the roller 134, namely, to the rotor 122, a main bearing portion that extends from the main shaft portion toward the roller 134 and into which a main bearing 131 is inserted, and a sub bearing portion into which a sub bearing 132 is inserted. The main bearing 131 and the sub bearing 132 may be disposed on both ends of the cylinder 133, respectively. The main bearing 131 and the sub bearing 132 are spaced apart from each other to define surfaces of the compression space V, respectively. For example, referring to FIGS. 1 to 3, the main bearing 131 may be disposed on an upper end of the cylinder 133 to define an upper surface of the compression space V, and the sub bearing 132 may be disposed on a lower end of the cylinder 133 to define a lower surface of the compression space V.

Referring to FIG. 1, the main bearing 131 may be fixedly installed in the intermediate shell 111 of the casing 110. For example, the main bearing 131 may be inserted into the intermediate shell 111 and welded thereto.

The main bearing 131 may be coupled to be in close contact with an upper end of the cylinder 133. Accordingly, the main bearing 131 defines an upper surface of the compression space V, and supports an upper surface of the roller 134 in the axial direction while supporting an upper-half portion of the rotational shaft 123 in a radial direction.

The main bearing 131 may include a main plate portion 1311 and a main bush portion 1312. The main plate portion 1311 may be coupled to the cylinder 133 to cover an upper side of the cylinder 133.

The main bush portion 1312 may extend in the axial direction from a center of the main plate portion 1311 toward the drive motor 120 to support the upper-half portion of the rotational shaft 123. The main plate portion 1311 may have a disk shape, and an outer circumferential surface of the main plate portion 1311 may be fixed in close contact to the inner circumferential surface of the intermediate shell 111.

Hereinafter, structure for returning oil accumulated at a low-pressure side and structure in which suctioned refrigerant is introduced into the compression space V will be described.

An oil sump space 131*b* may be defined in or at an upper surface of the main bearing 131. The oil sump space 131*b* may be connected to the suction port 1311*a*, to guide refrigerant gas to be suctioned into the compression space V during a suction process and to be returned during a discharge process.

In addition, in embodiments, the upper surface of the main bearing 131 is a space in which suction refrigerant is accommodated and forms a low pressure, and a high pressure is formed below the main bearing 131. More specifically, for example, as illustrated in FIGS. 1, and 5A, for example, a sealing portion 1314 is formed adjacent to a center of the upper surface of the main bearing 131, a sealing portion disposed inside of the casing 110 is brought into contact with a side portion of the main bearing 131. By those sealing portions, suction space 111*a* may be understood as a low-pressure space, and a portion below the sealing portion 1314 as a high-pressure space.

Figure 5B:
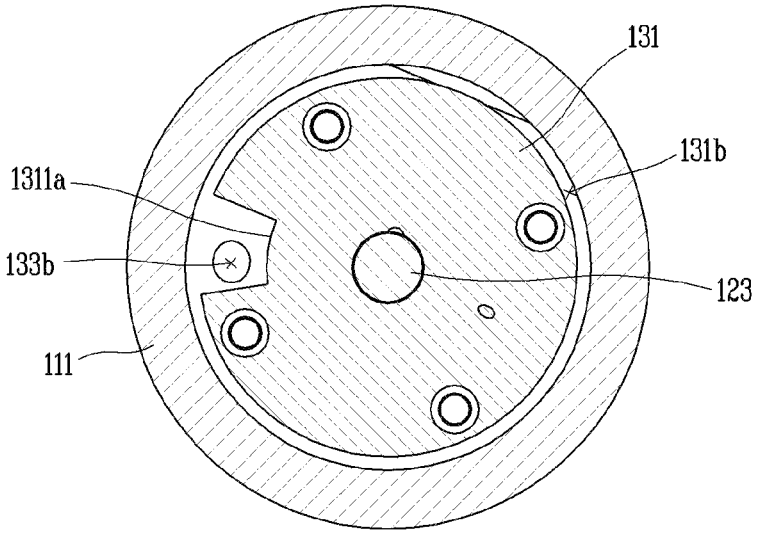
FIG. 5B is a lateral cross-sectional view illustrating an upper portion of a main bearing of FIG. 5A.
Figure 5C:
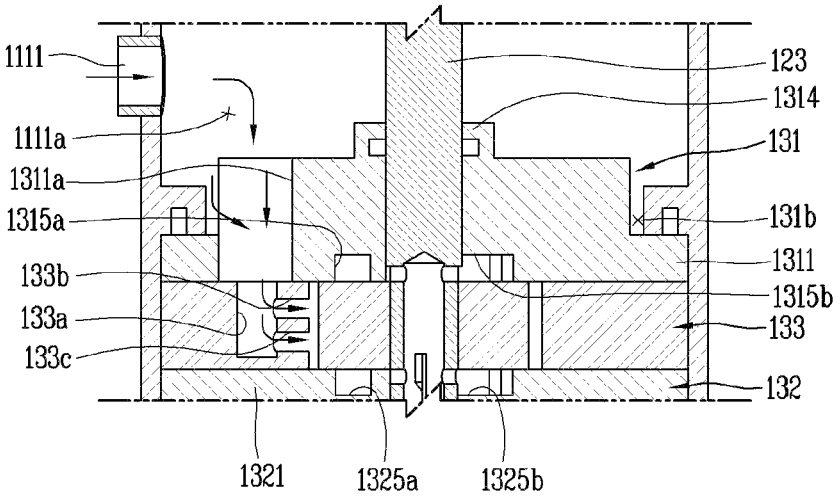
FIG. 5C is longitudinal cross-sectional view illustrating a suction passage defined in the compression unit of the rotary compressor according to an embodiment.

The oil sump space 131*b* may be formed in or at the upper surface of the main bearing 131 in a circumferential direction. FIG. 5B illustrates an example in which the oil sump space 131*b* is formed in the upper surface of the main plate portion 1311 in the circumferential direction and communicates with a suction port 1311*a* described hereinafter.

In addition, the suction port 1311*a* may be formed in the upper surface of the main bearing 131. The suction port 1311*a* may be formed through the main bearing 131 in the vertical (up and down) direction. Due to this, refrigerant introduced through the suction tube 1111 may move downward through the suction port 1311*a* to be introduced into the compression space V of the cylinder 133.

FIG. 5A illustrates an example in which the suction port 1311*a* is formed through upper and lower ends of the main bearing 131. On the other hand, FIG. 5B illustrates an example in which the suction port 1311*a* is connected to the oil sump space 131*b*. A cross section of the suction port 1311*a* in a transverse direction is formed at a predetermined angle in the circumferential direction.

The suction port 1311*a* guides refrigerant introduced through a suction passage disposed in the casing 110 to the compression space V of the cylinder 133. Referring to FIG. 5B, the suction port 1311*a* and the suction hole 133*a* are disposed to overlap each other when viewed from a top.

As the suction port 1311*a* and the suction hole 133*a* are disposed at overlapping positions in FIG. 5B, structure may be implemented in which refrigerant inside of a low-pressure space is introduced into the compression space V via the suction port 1311*a* of the main bearing 131 and the suction hole 133*a* of the cylinder 133 while minimizing flow loss.

The suction hole 133*a* of the cylinder 133 may be formed in the vertical direction, as illustrated in FIG. 5A. In addition, the cylinder 133 may include first and second communication holes 133*b* and 133*c* that provides communication between the suction hole 133*a* and the compression space V. The first and second communication holes 133*b* and 133*c* provide communication between the suction hole 133*a* and the compression space V, such that refrigerant supplied through the suction hole 133*a* may flow into the compression space V.

The first and second communication holes 133*b* and 133*c* may be spaced apart from each other in the vertical direction, and a flow rate of the refrigerant flowing into the first and second communication holes 133*b* and 133*c* from the suction hole 133*a* may be adjusted. In this way, oil accumulated in or at the low-pressure side, that is, in or at the upper side of the main bearing 131, flows into the suction port 1311*a* through the oil sump space 131*b*. In addition, refrigerant introduced into the rotary compressor 100 through the suction tube 1111 flows into the compression space V via the suction port 1311*a* of the main bearing 131, the suction hole 133*a* of the cylinder 133, and the first and second communication holes 133*b* and 133*c*.

As described above, the sub bearing 132 may be disposed on the lower end of the cylinder 133 to define the lower surface of the compression space V. The sub bearing 132 has the discharge chamber 1321*a* that accommodates discharged refrigerant and oil therein. To define the discharge chamber 1321*a*, the sub bearing cover 136 may be coupled to a bottom of the sub bearing 132.

The sub bearing 132 may include a sub plate portion 1321 and a sub bush portion 1322. The sub plate portion 1321 may be coupled to the cylinder 133 to cover the lower side of the cylinder 133.

The sub bush portion 1322 may extend in the axial direction from a center of the sub plate portion 1321 toward the lower shell 112 to support a lower-half portion of the rotational shaft 123. The sub plate portion 1321 may have a disk shape like the main plate portion 1311, and an outer circumferential surface of the sub plate portion 1321 may be spaced apart from the inner circumferential surface of the intermediate shell 111.

The sub bearing 132 may further include a sub side wall 1323. The sub side wall 1323 may protrude downward from an edge portion of the sub plate portion 1321. The sub side wall 1323 may extend in the circumferential direction from the edge portion of the sub plate portion 1321.

Referring to FIG. 5A, the sub side wall 1323 may be coupled to the inner circumference of the casing 110 to stably support the rotational shaft 123 on the inner circumference of the sub bush portion 1322. The sub side wall 1323 may have a predetermined width and may be coupled to the inner circumference of the casing 110 to maintain sufficient rigidity.

The discharge chamber 1321*a* may be defined between the sub bearing cover 136 and an inner circumferential space of the sub side wall 1323. In addition, a bottom of the sub side wall 1323 may be in surface contact with an upper surface of the sub bearing cover 136. Referring to FIG. 5A, for example, an example in which the sub bearing cover 136 is coupled to the bottom of the sub bearing 132 is illustrated.

The sub bearing cover 136 may include a sub boss portion 136*b* that protrudes toward the sub bearing 132. The sub boss portion 136*b* may protrude upward from a portion of the sub bearing cover 136 which is spaced apart from the inner circumference of the sub bearing cover 136 by a predetermined distance. The sub boss portion 136*b* forms a structure, in which an inner circumference thereof is brought into contact with an outer circumference of the sub bush portion 1322 of the sub bearing 132, when inserted.

In addition, a sub support portion 136*c* may be disposed at an inner side of the sub boss portion 136*b*. Accordingly, the sub bearing cover 136 may be inserted into the sub bearing 132 while supporting a lower end of the sub bush portion 1322 of the sub bearing 132.

In embodiments, as the sub bearing cover 136 is coupled to the bottom of the sub bearing 132 to define the discharge chamber 1321*a*, interference between compressed refrigerant and oil accumulated on the bottom may be suppressed or prevented during a discharge process of the refrigerant.

However, as the discharge chamber 1321*a* defined by the sub bearing 132 and the sub bearing cover 136 has a small inner space, there is a possibility that discharged oil and refrigerant gas is discharged directly out of the compressor. In addition, as the discharged oil is likely to be accumulated in or at the low-pressure side when suctioned again after circulating an entire line, a return of the oil is required.

Figure 4B:
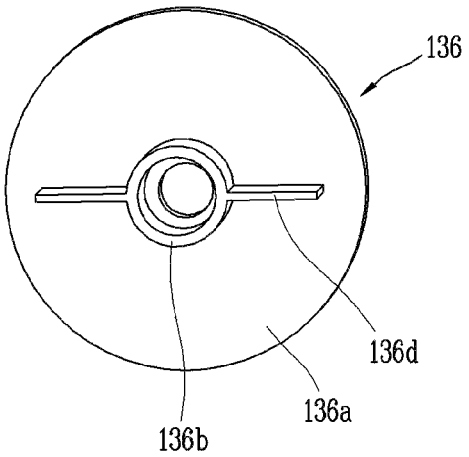
FIG. 4B is a plan view illustrating an inside of a sub bearing cover.

As described above, the first and second barrier ribs 1321*b* and 136*d* may be formed on the sub bearing 132 and the sub bearing cover 136, respectively. The second barrier rib 1321*b* of the sub bearing 132 may protrude toward the sub bearing cover 136 from an inner upper surface of the sub bearing 132 in which the discharge chamber 1321*a* is defined. As shown in FIGS. 4A-4B, the first and second barrier ribs 1321*b* and 136*d* may each be a plate-shaped rib that extends linearly in a radial direction of the sub bearing 132 and the sub bearing cover 136, respectively. An example in which the second barrier rib 1321*b* of the sub bearing 132 is disposed in the radial direction is illustrated in FIG. 4A.

For example, the second barrier rib 1321*b* of the sub bearing 132 may be spaced apart from a central portion of the sub bearing 132 by a predetermined distance. In addition, the barrier rib (first barrier rib 136*d*) of the sub bearing cover 136 may protrude from the inside of the sub bearing cover 136. The barrier rib of the sub bearing cover 136 may be spaced apart from a central portion of the sub bearing cover 136 by a predetermined distance.

Also, as illustrated in FIG. 3, the second barrier rib 1321*b* of the sub bearing 132 and the first barrier rib 136*d* of the sub bearing cover 136 may be spaced apart from each other in the lateral direction based on the drawing. As the barrier ribs are formed in the sub bearing 132 and the sub bearing cover 136, respectively, oil may collide with the barrier ribs before being discharged to the outside from the discharge chamber 1321*a*, thereby being returned without being discharged to the outside.

A discharge valve 1322*a* may be disposed inside of the sub bearing 132 to enable discharge of refrigerant compressed in the compression space V in the cylinder 133. The refrigerant compressed in the compression space V may be discharged to the discharge chamber 1321*a* when the discharge valve 1322*a* is open.

Oil collides with the barrier ribs formed respectively in the sub bearing 132 and the sub bearing cover 136. Accordingly, oil which is flowing together with refrigerant gas is returned.

When oil passes through an upper end of the barrier rib of the sub bearing cover 136, which is 1 to 2 mm lower than a height of the discharge chamber 1321*a*, the oil may flow to a lower end due to the barrier rib of the sub bearing 132. During this process, a movement distance of refrigerant gas may be increased, and a collision may be caused in a narrow structure due to the barrier ribs and an adjacent narrow passage. The refrigerant that has passed through the barrier rib in the discharge chamber 1321*a* is finally discharged through the discharge tube 1112.

The related art low-pressure type vane rotary compressor generally has a horizontal structure. Due to the structure, a valve has been used to minimize accumulation of oil in a low-pressure portion or minimize an oil circulation rate. In the case of a vertical structure rather than a horizontal type, such problem can be solved by re-suctioning oil accumulated in the low-pressure side.

In embodiments, a valve applied for oil return may be replaced by the application of the barrier rib structure, which may result in obtaining an effect of eliminating the valve through machining change.

Hereinafter, a processing of oil accumulation in a journal of the main bearing 131 and the discharge chamber 1321*a* will be described.

Figure 6A:
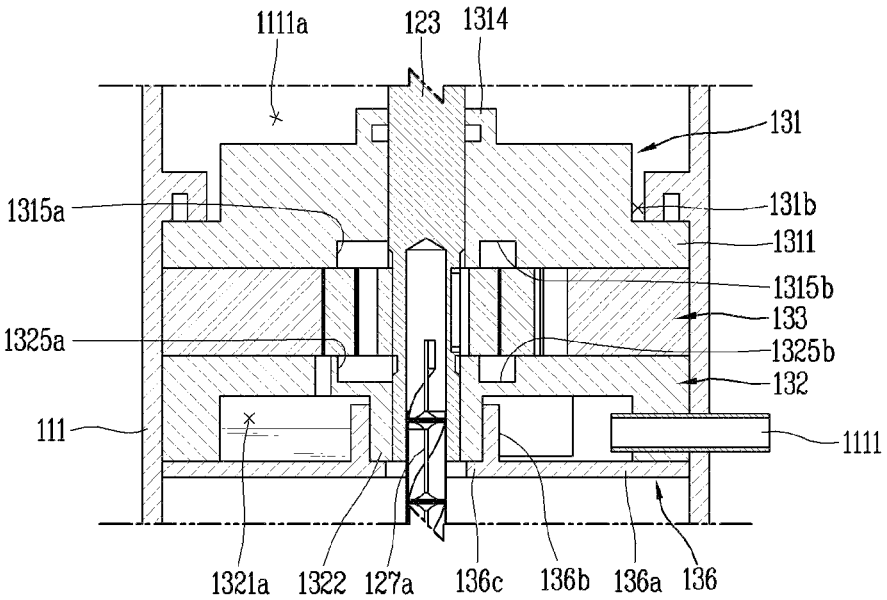
FIG. 6A is a longitudinal cross-sectional view illustrating a surface of the compression unit of the rotary compressor according to an embodiment.
Figure 6B:
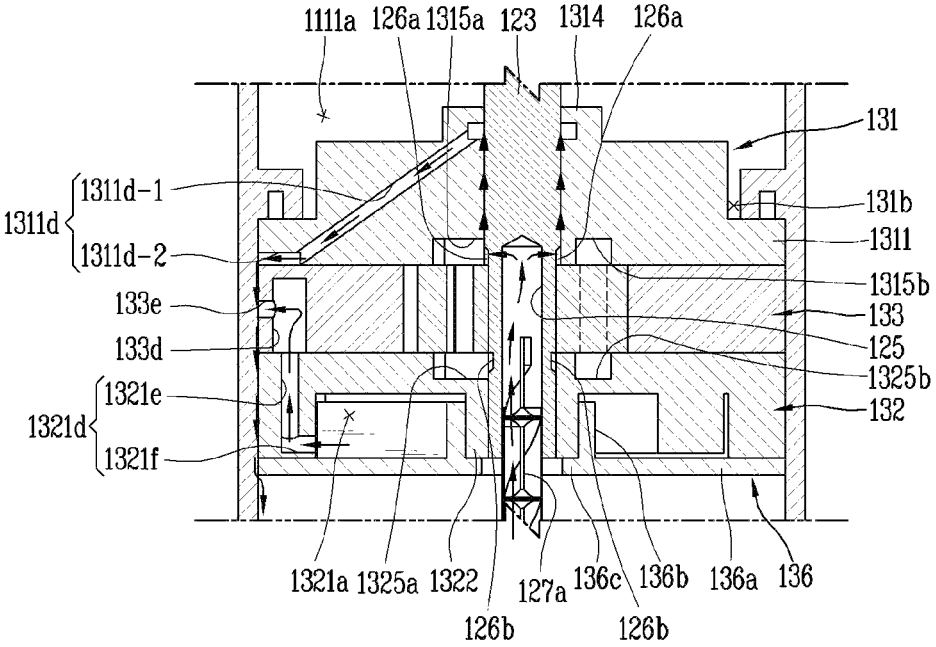
FIG. 6B is a longitudinal cross-sectional view illustrating an oil communication passage and an oil exhaust space on another surface of the compression unit of the rotary compressor according to an embodiment.

For processing the oil accumulated in the discharge chamber 1321*a*, as illustrated in FIG. 6B, the sub bearing 132 may include an oil communication passage 1321*d* that communicates with the discharge chamber 1321*a*. The oil communication passage 1321*d* may include a first passage 1321*f* that communicates laterally with the discharge chamber 1321*a* and a second passage 1321*e* that extends upward and communicates with the first passage 1321*f*. By the formation of the oil communication passage 1321*d*, oil that flows toward the barrier rib of the sub bearing 132 may be minimized and oil that flows opposite to the barrier rib may be supplied into an oil storage space.

On the other hand, the oil communication passage 1321*d* communicates with a bottom of the cylinder 133. As illustrated in FIG. 6B, the cylinder 133 may have an oil exhaust space 133*d* that communicates with the oil communication passage 1321*d*. The oil exhaust space 133*d* may be configured to communicate with the oil communication passage 1321*d* at the bottom of the cylinder 133.

As illustrated in FIG. 6B, the oil exhaust space 133*d* may have a larger diameter than the oil communication passage 1321*d*.

In addition, the cylinder 133 may have an oil communication passage 133*e* that communicates with the oil exhaust space 133*d* and is formed in the lateral direction. One or a first side of the oil communication passage 133*e* may communicate with the oil exhaust space 133*d* and another or a second side may be formed through an outer circumference of the cylinder 133. Oil discharged to the oil communication passage 133*e* may flow downward through a gap between the cylinder 133 and the inner circumference of the casing 110 to be discharged into the oil storage space.

The cylinder 133 may be fitted onto the inner circumference of the casing 110. The cylinder 133 and the casing 110 may be disposed to define a fine gap, through which oil may flow, between the outer circumference of the cylinder 133 and the inner circumference of the casing 110.

Figure 6C:
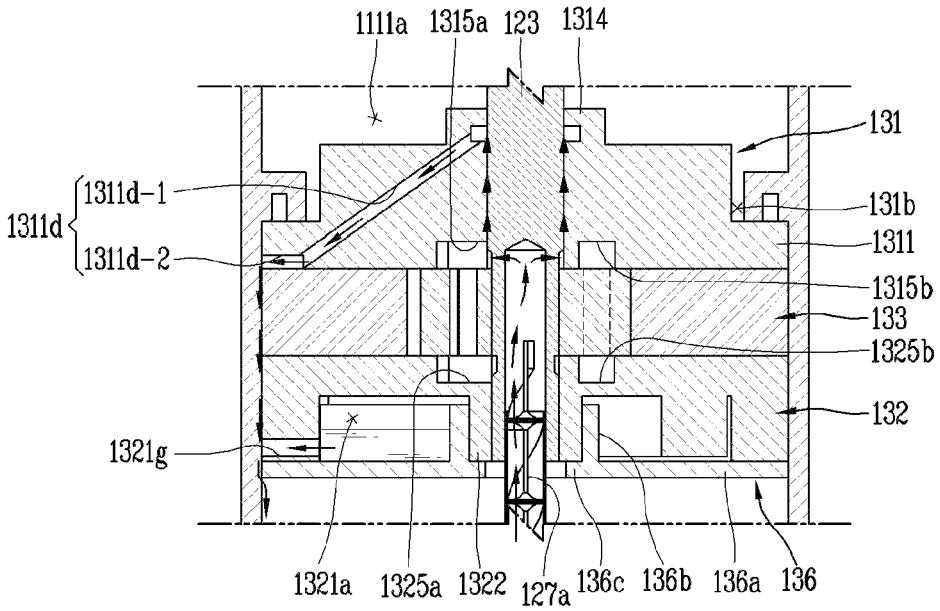
FIG. 6C is a longitudinal cross-sectional view illustrating an example of an oil exhaust passage of the compression unit of the rotary compressor according to an embodiment.

Also, referring to FIG. 6C, an example in which the sub bearing 132 includes an oil exhaust passage 1321*g* formed through between a side portion of the discharge chamber 1321*a* and an outer circumference of the sub bearing 132 is illustrated. The oil exhaust passage 1321*g* may be formed through the side portion of the discharge chamber 1321*a* to be parallel to the lateral direction.

Oil discharged to the oil exhaust passage 1321*g* from the discharge chamber 1321*a* may flow downward through a gap between the cylinder 133 and the inner circumference of the casing 110 to be discharged into the oil storage space.

Figure 6D:
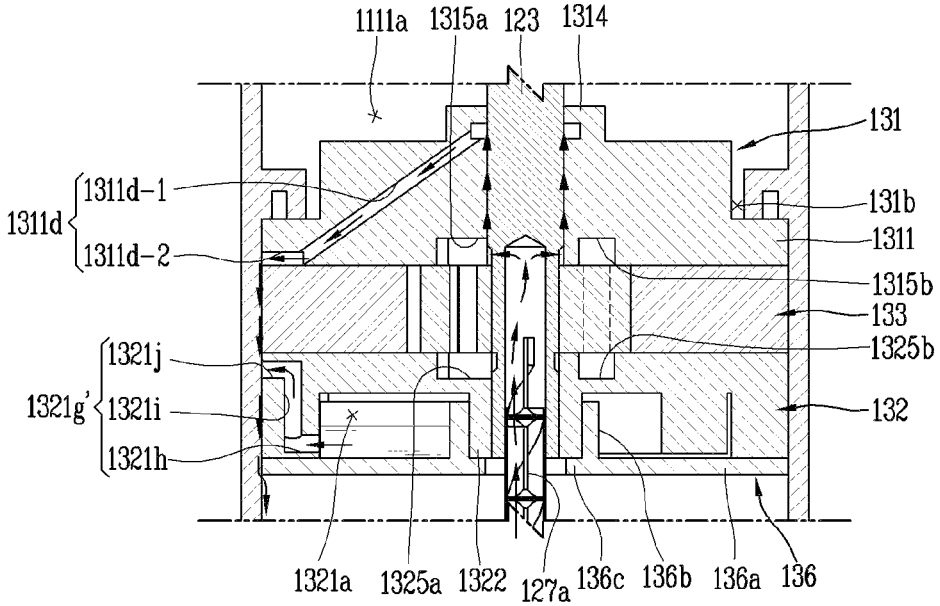
FIG. 6D is a longitudinal sectional view illustrating another example of an oil exhaust passage of the compression unit of the rotary compressor according to an embodiment.
Figure 7:
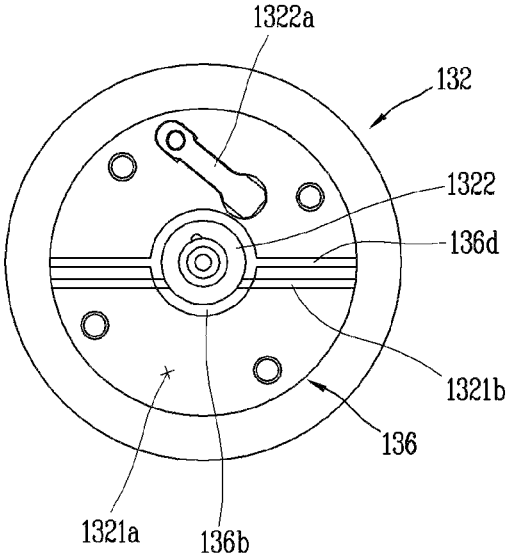
FIG. 7 is a plan view illustrating a discharge chamber in a sub bearing.

In FIG. 6D, another example of an oil exhaust passage 1321*g*' is illustrated. The oil exhaust passage 1321*g*' may be formed in a shape that is bent at least twice from the side portion of the discharge chamber 1321*a* to the outer circumference of the sub bearing 132. In addition, the oil exhaust passage 1321*g*' may include a first exhaust passage 1321*h* that communicates with the side portion of the discharge chamber 1321*a* and formed in the lateral direction, a second exhaust passage 1321*j* having one end that communicates with the outer circumference of the sub bearing 132 to be in parallel to the first exhaust passage 1321*h*, and a third exhaust passage 1321*i* formed vertically to provide communication between the first and second exhaust passages 1321*h* and 1321*j*.

As illustrated in FIG. 6D, as the oil exhaust passage 1321*g*' may be formed in the shape bent twice and include the first to third exhaust passages 1321*h*, 1321*j*, and 1321*i*, oil that has been discharged from the discharge chamber 1321*a* to the first to third exhaust passages 1321*h*, 1321*j*, and 1321*i* then flows downward through the gap between the cylinder 133 and the inner circumference of the casing 110 so as to be discharged to the oil storage space.

A sealing portion 1314 may be disposed between the main bearing 131 and the rotational shaft 123. As illustrated in FIGS. 6B to 6D, an example in which the sealing portion 1314 is disposed at an inner side on an upper portion of the main bearing 131. The sealing portion 1314 disposed on the upper portion of the main bearing 131 may seal a gap between the main bearing 131 and the rotational shaft 123, thereby suppressing or preventing oil at a high pressure from being discharged from the compression space V to the low-pressure side.

However, as oil may stagnate due to being gathered in the sealing portion 1314, the oil gathered in the sealing portion 1314 should be forced to flow into the oil storage space of the high-pressure side. The sealing portion 1314 may have an O-ring 1314*a* therein.

The main bearing 131 may have an oil guide passage 1311*d* formed such that the sealing portion 1314 and the outer circumference of the main bearing 131 communicate with each other. The oil guide passage 1311*d* enables oil to flow downward in the main bearing 131 and guides the oil, which stagnates due to the sealing portion 1314, to flow into the oil storage space.

The oil guide passage 1311*d* may be at least partially inclined downward to provide communication between the sealing portion and the outer circumference of the main bearing 131. The oil guide passage 1311*d* may include a first guide passage 1311*d*-1 and a second guide passage 1311*d*-2. One side of the first guide passage 1311*d*-1 may communicate with the sealing portion 1314 and may be inclined downward toward the outer circumference of the main bearing 131. As illustrated in FIGS. 6B to 6D, an example is shown in which the first guide passage 1311*d*-1 extends from a right upper portion (upper center based on the drawing as a whole) where the rotational shaft 123 is disposed to a left lower portion.

The second guide passage 1311*d*-2 may be disposed such that one or a first side thereof communicates with a lower portion of the first guide passage 1311*d*-1 and another or a second side communicates with the outer circumference of the main bearing 131. The second guide passage 1311*d*-2 may also be formed in parallel to the lateral direction in the bottom of the main bearing 131. Accordingly, oil that stagnates in the sealing portion 1314 may flow into the gap between the main bearing 131 and the casing 110 through the oil guide passage 1311*d*, so as to be discharged into the oil storage space.

The main bearing 131 may be fitted onto the inner circumference of the casing 110 on a top of the cylinder 133. The main bearing 131 and the casing 110 may be disposed to define a fine gap, through which oil may flow, between the outer circumference of the cylinder 131 and the inner circumference of the casing 110.

Referring to FIG. 5A, for example, a first main back pressure pocket 1315*a* and a second main back pressure pocket 1315*b* may be formed in a lower surface of the main plate portion 1311 facing the upper surface of the roller 134, of both axial side surfaces of the main plate portion 1311. The first main back pressure pocket 1315*a* and the second main back pressure pocket 1315*b*, each having an arcuate shape, may be disposed at a predetermined interval in the circumferential direction. Each of the first main back pressure pocket 1315*a* and the second main back pressure pocket 1315*b* may have an inner circumferential surface formed in a circular shape, but may have an outer circumferential surface formed in an oval or elliptical shape in consideration of vane slots 1342*a*, 1342*b*, and 1342*c* described hereinafter.

Both the first and second main back pressure pockets 1315*a* and 1315*b* may have inner circumferential surfaces formed in a circular shape and outer circumferential surfaces formed in an elliptical shape; however, embodiment are not limited to this structure. For example, the first main back pressure pocket 1315*a* may accommodate refrigerant of high pressure to apply back pressure of high pressure to a rear end of the vane 1351, 1352, 1353, and the second main back pressure pocket 1315*b* may accommodate refrigerant of intermediate pressure to apply back pressure of intermediate pressure to the rear end of the vane 1351, 1352, 1353.

The first main back pressure pocket 1315*a* and the second main back pressure pocket 1315*b* may be formed within an outer diameter range of the roller 134. Accordingly, the first main back pressure pocket 1315*a* and the second main back pressure pocket 1315*b* may be separated from the compression space V.

For example, back pressure in the first main back pressure pocket 1315*a* may be higher than back pressure in the second main back pressure pocket 1315*b*. That is, the first main back pressure pocket 1315*a* may be disposed in a vicinity of the discharge port 1313*a*, 1313*b*, and 1313*c* to apply discharge back pressure. In addition, the second main back pressure pocket 1315*b* may form an intermediate pressure between a suction pressure and a discharge pressure.

Oil (refrigerant oil) may pass through a fine passage between a first main bearing protrusion described hereinafter and the upper surface of the roller 134 so as to be introduced into the first main back pressure pocket 1315*a*. The second main back pressure pocket 1315*b* may be formed in the range of a compression chamber forming the discharge pressure in the compression space V. This may allow the second main back pressure pocket 1315*b* to maintain the intermediate pressure.

The second main back pressure pocket 1315*b* may form the intermediate pressure lower than a pressure formed in the first main back pressure pocket 1315*a*. Oil flowing into a main bearing hole of the main bearing 131 through the first oil passage hole 126*a* may be introduced into the second main back pressure pocket 1315*b*. The second main back pressure pocket 1315*b* may be formed in the range of a compression chamber forming the suction pressure in the compression space V. This may allow the second main back pressure pocket 1315*b* to maintain the suction pressure.

In addition, a first main bearing protrusion and a second main bearing protrusion may be formed on inner circumferential sides of the first main back pressure pocket 1315*a* and the second main back pressure pocket 1315*b*, respectively, in a manner of extending from the main bearing surface of the main bush potion 1312. Accordingly, the first main back pressure pocket 1315*a* and the second main back pressure pocket 1315*b* may be sealed from outside and simultaneously the rotational shaft 123 may be stably supported.

A back pressure chamber (not illustrated) may be formed at an inner end of the vane slot 1342*a*, 1342*b*, 1342*c* (FIG. 2). In a state of communicating with the back pressure pocket 1315*a*, 1315*b*, 1325*a*, 1325*b*, the back pressure chamber receives back pressure from the back pressure pocket 1315*a*, 1315*b*, 1325*a*, 1325*b* to press the vane 1351, 1352, 1353 toward the inner circumference of the cylinder 133.

Detailed description of the configuration of the back pressure chamber and the vane slot have been omitted.

In embodiments, an example in which the back pressure pocket 1315*a*, 1315*b*, 1325*a*, 1325*b* is disposed in each of the main bearing 131 and the sub bearing 132 is illustrated.

In addition, each of the main bearing 131 and the sub bearing 132 may include one or more back pressure pockets 1315*a*, 1315*b*, 1325*a*, 1325*b*. An example is described in which two back pressure pockets are formed in each of the main bearing 131 and the sub bearing 132. However, embodiments are not limited to this structure. An example in which the back pressure pocket 1315*a*, 1315*b*, 1325*a*, 1325*b* is disposed only in the main bearing 131 or another example in which three back pressure pockets 1315*a*, 1315*b*, 1325*a*, 1325*b* are disposed in each of the main bearing 131 and the sub bearing 132 may also be applied.

The main bearing 131 may include main plate 1311 coupled to the cylinder 133 to cover the upper side of the cylinder 133. In addition, the sub bearing 132 may include sub plate 1321 coupled to the cylinder 133 to cover the lower side of the cylinder 133.

The back pressure pockets 1315*a*, 1315*b*, 1325*a*, 1325*b* may include first and second main back pressure pockets 1315*a* and 1315*b* spaced apart from a lower surface of the main plate 1311 of the main bearing 131 at a predetermined distance. In addition, the back pressure pockets 1315*a*, 1315*b*, 1325*a*, 1325*b* may further include first and second sub back pressure pockets 1325*a* and 1325*b* spaced apart from the upper surface of the sub bearing 132 at a predetermined distance.

Detailed configurations of the first and second main back pressure pockets 1315*a* and 1315*b* and the first and second sub back pressure pockets 1325*a* and 1325*b* will be described hereinafter.

The compression unit 130 may include the cylinder 133, the roller 134, the plurality of vanes 1351, 1352, and 1353, the main bearing 131, and the sub bearing 132. The main bearing 131 and the sub bearing 132 are respectively provided on upper and lower sides of the cylinder 133 to define the compression space V together with the cylinder 133. The roller 134 is rotatably installed in the compression space V, and the vanes 1351, 1352, and 1353 are slidably inserted into the roller 134. The plurality of vanes 1351, 1352, and 1353 is brought into contact with the inner circumference of the cylinder 133 to divide the compression space V into a plurality of compression spaces V.

Referring to FIGS. 1 and 2, the sub bearing 132 may be coupled in close contact to the lower end of the cylinder 133. Accordingly, the sub bearing 132 defines the lower surface of the compression space V, and supports the lower surface of the roller 134 in the axial direction while supporting the lower portion of the rotational shaft 123 in the radial direction.

Referring to FIGS. 1 and 2, the sub bearing 132 may include sub plate portion 1321 and sub bush portion 1322. The sub plate portion 1321 may be coupled to the cylinder 133 to cover the lower side of the cylinder 133.

The sub bush portion 1322 may extend in the axial direction from a center of the sub plate portion 1321 toward the lower shell 112 to support the lower-half portion of the rotational shaft 123. The sub plate portion 1321 may have a disk shape like the main plate portion 1311, and an outer circumferential surface of the sub plate portion 1321 may be spaced apart from the inner circumferential surface of the intermediate shell 111.

A first sub back pressure pocket 1325*a* and a second sub back pressure pocket 1325*b* may be formed on an upper surface of the sub plate portion 1321 facing the lower surface of the roller 134, of both axial side surfaces of the sub plate portion 1321.

The first sub back pressure pocket 1325*a* and the second sub back pressure pocket 1325*b* may be symmetric to the first main back pressure pocket 1315*a* and the second main back pressure pocket 1315*b*, respectively, with respect to the roller 134. Also, the first and second sub back pressure pockets 1325*a* and 1325*b* may be formed in a shape corresponding to the first and second main back pressure pockets 1315*a* and 1315*b*, respectively.

For example, the first sub back pressure pocket 1325*a* and the first main back pressure pocket 1315*a* may be symmetrical to each other with the roller 134 interposed therebetween, and the second sub back pressure pocket 1325*b* and the second main back pressure pocket 1315*b* may be symmetrical to each other with the roller 134 interposed therebetween. Accordingly, a first sub bearing protrusion may be formed on an inner circumferential side of the first sub back pressure pocket 1325*a*, and a second sub bearing protrusion may be formed on an inner circumferential side of the second sub back pressure pocket 1325*b*.

However, in some cases, the first sub back pressure pocket 1325*a* and the second sub back pressure pocket 1325*b* may be asymmetrical to the first main back pressure pocket 1315*a* and the second main back pressure pocket 1315*b*, respectively, with respect to the roller 134. For example, the first sub back pressure pocket 1325*a* and the second sub back pressure pocket 1325*b* may be formed to have different depths from the first main back pressure pocket 1315*a* and the second main back pressure pocket 1315*b*, respectively.

In addition, an oil supply hole (not illustrated) may be formed between the first sub back pressure pocket 1325*a* and the second sub back pressure pocket 1325*b*, more precisely, between the first sub bearing protrusion and the second sub bearing protrusion or in a portion where the first sub bearing protrusion and the second sub bearing protrusion are connected to each other. For example, a first end defining an entrance of the oil supply hole (not illustrated) may be submerged in the oil storage space 110*b*, and a second end defining an exit of the oil supply hole may be located on a rotational path of the back pressure chamber in the upper surface of the sub plate portion 1321 facing the lower surface of the roller 134 described hereinafter. Accordingly, when the roller 134 rotates, the back pressure chamber may periodically communicate with the oil supply hole (not illustrated), such that oil of high pressure stored in the oil storage space 110*b* may be periodically supplied to the back pressure chamber through the oil supply hole (not illustrated). This may allow the vane 1351, 1352, 1353 to be stably supported toward the inner circumferential surface 1332 of the cylinder 133.

The sub bush portion 1322 may be formed in a hollow bush shape, and a second oil groove (not illustrated) may be formed in an inner circumferential surface of the sub bearing hole that defines an inner circumferential surface of the sub bush portion 1322. The second oil groove 1322*c* may be formed in a straight or inclined shape between upper and lower ends of the sub bush portion 1322, such that an upper end thereof may communicate with the second oil passage hole 126*b*.

Although not illustrated in the drawing, the oil groove may be formed in an oblique or spiral shape in the outer circumferential surface of the rotational shaft 123, that is, the outer circumferential surface of the sub bearing portion 123*c*.

Although not illustrated in the drawings, the back pressure pocket 1315*a*, 1315*b*, 1325*a*, 1325*b* may be disposed only in any one of the main bearing 131 or the sub bearing 132.

Referring to FIGS. 1 to 3, the cylinder 133 according to this embodiment may be in close contact with the lower surface of the main bearing 131 and may be coupled to the main bearing 131 by, for example, a bolt together with the sub bearing 132. As described above, as the main bearing 131 is fixedly coupled to the casing 110, the cylinder 133 may be fixedly coupled to the casing 110 by the main bearing 131.

The cylinder 133 may be formed in an annular shape having a hollow space in its center to define the compression space V. The hollow space may be sealed by the main bearing 131 and the sub bearing 132 to define the compression space V, and the roller 134 may be rotatably coupled to the compression space V.

Referring to FIGS. 1 and 2, the roller 134 according to this embodiment may be rotatably disposed in the compression space V of the cylinder 133, and the plurality of vanes 1351, 1352, and 1353 may be inserted in the roller 134 at predetermined intervals along the circumferential direction. Accordingly, the compression space V may be divided into as many compression spaces as the number of the plurality of vanes 1351, 1352, and 1353. This embodiment illustrates an example in which the plurality of vanes 1351, 1352, and 1353 is three in number, and thus, the compression space V is partitioned into three compression spaces V.

In addition, a plurality of vane slots 1342*a*, 1342*b*, and 1342*c* may be formed in the outer circumferential surface 1341 of the roller 134 to be spaced apart from each other in the circumferential direction. The plurality of vanes 1351, 1352, and 1353 described hereinafter may be slidably inserted into the plurality of vane slots 1342*a*, 1342*b*, and 1342*c*, respectively.

Referring to FIG. 2, the plurality of vane slots 1342*a*, 1342*b*, and 1342*c* includes first vane slot 1342*a*, second vane slot 1342*b*, and third vane slot 1342*c*. The first vane slot 1342*a*, the second vane slot 1342*b*, and the third vane slot 1342*c* may be formed to have a same width and depth at equal or unequal intervals along the circumferential direction. An example is described herein in which the vane slots are spaced apart by equal intervals.

For example, each of the vane slots 1342*a*, 1342*b*, and 1342*c* may be inclined at a preset or predetermined angle with respect to the radial direction, so as to secure a sufficient length of each of the vanes 1351, 1352, and 1353. Accordingly, when the inner circumferential surface 1332 of the cylinder 133 is formed in the asymmetric elliptical shape, separation of the vanes 1351, 1352, and 1353 from the vane slots 1342*a*, 1342*b*, and 1342*c* may be suppressed or prevented even if a distance from the outer circumferential surface 1341 of the roller 134 to the inner circumferential surface 1332 of the cylinder 133 increases. This may result in enhancing the freedom of design for the inner circumferential surface 1332 of the cylinder 133.

Hereinafter, operation of the rotary compressor 100 according to an embodiment will be described.

That is, when power is applied to the drive motor 120, the rotor 122 of the drive motor 120 and the rotational shaft 123 coupled to the rotor 122 rotate together, causing the roller 134 coupled to the rotational shaft 123 or integrally formed therewith to rotate together with the rotational shaft 123. Then, the plurality of vanes 1351, 1352, and 1353 may be drawn out of the vane slots 1342*a*, 1342*b*, and 1342*c* by centrifugal force generated by rotation of the roller 134 and back pressure of the back pressure chambers (not illustrated), which support the rear end surfaces of the vanes 1351, 1352, and 1353, so as to be brought into contact with the inner circumferential surface 1332 of the cylinder 133.

The compression space V of the cylinder 133 is thus partitioned by the plurality of vanes 1351, 1352, and 1353 into compression spaces V as many as the number of the plurality of vanes 1351, 1352, and 1353. A volume of each of the compression spaces V is varied by the shape of the inner circumferential surface 1332 of the cylinder 133 and eccentricity of the roller 134 while moving along the rotation of the roller 134. Refrigerant suctioned into each of the compression spaces V is compressed while moving along the roller 134 and the vanes 1351, 1352, and 1353 and is discharged to the discharge chamber 1321*a* of the sub bearing 132. This series of processes is repeatedly carried out.

While refrigerant and oil pass between the first barrier rib 136*d* and the upper surface of the discharge chamber 1321*a* within the discharge chamber 1321*a*, the oil blocked by the first barrier rib 136*d* is partially separated from the refrigerant, and passes through the first barrier rib 136*d*. Thereafter, while passing through the second barrier rib 1321*b* and a surface of the sub bearing cover 136, that is, the lower surface of the discharge chamber 1321*a*, the oil is secondarily separated from the refrigerant and discharged to the outside of the compressor through the discharge tube 1112.

In addition, the oil flows out through the first to third exhaust passages 1321*h*, 1321*j*, and 1321*i* of the oil exhaust passage 133*e*. With the structure of the oil exhaust passage 133*e*, an additional space may be defined in the discharge chamber 1321*a*, and an amount of oil, which has been accumulated and then moves toward the barrier rib at the moment when the high-pressure gas is discharged from the compression space V, may be minimized. That is, when the high-pressure gas is discharged, the oil exhaust passage 133*e* serves as a damper, and a predetermined amount or more of oil exhausts into the oil storage space through a gap between the outer circumference of the sub bearing 132 and the casing 110.

Figure 8:
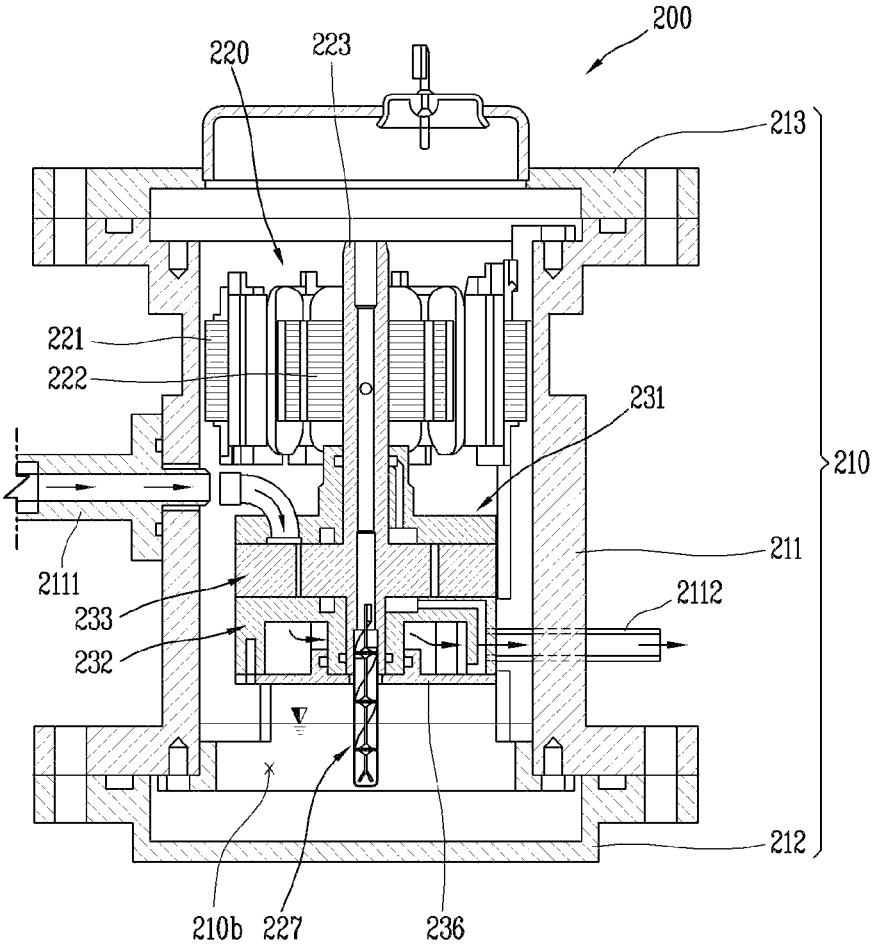
FIG. 8 is a longitudinal cross-sectional view illustrating a rotary compressor according to another embodiment.

FIG. 8 is a longitudinal cross-sectional view of a rotary compressor according to another embodiment.

Hereinafter, rotary compressor 200 according to this embodiment will be described, with reference to FIG. 8.

As illustrated in FIG. 8, the rotary compressor 200 of FIG. 8 may include a casing 210, a drive motor 220, and a compression unit. The casing 210 may include an intermediate shell 211 having a cylindrical shape, a lower shell 212 that covers a lower end of the intermediate shell 211, and an upper shell 213 that covers an upper end of the intermediate shell 211.

The drive motor 220 constitutes a motor unit that supplies power to cause the compression unit 230 to be driven. The drive motor 220 may include a stator 221, a rotor 222, and a rotational shaft 223.

Like the rotary compressor 100 described above in FIG. 1, for example, the rotary compressor 200 of FIG. 8 is configured such that the compression unit includes a cylinder 233, a roller, a main bearing 231, and a sub bearing 232. The cylinder 233 has an inner circumferential surface in an annular shape to define a compression space. The roller is rotatably disposed in the compression space of the cylinder 233, and vanes are slidably inserted into vane slots disposed at predetermined intervals along an outer circumferential surface of the roller.

The main bearing 231 and the sub bearing 232 are disposed on both upper and lower sides of the cylinder 233, respectively, to define the compression space together with the cylinder 233. The roller is rotatably disposed in the compression space. The plurality of vanes is brought into contact with an inner circumference of the cylinder 233 to partition the compression space into a plurality of compression chambers.

In the rotary compressor 200 of FIG. 8, in relation to pressure separation, the drive motor 220 is disposed at the top. In addition, refrigerant is supplied from the outside of the compressor directly into the compression space within the cylinder 233 through a suction tube 2111. A discharge chamber defined in the sub bearing 232 to which compressed refrigerant is supplied is formed as a high-pressure space and an upper space of the drive motor 220, an oil storage space, for example, within the casing 210 are formed as a low-pressure space. A discharge tube 2112 is coupled to the discharge chamber so that the discharged refrigerant exhausts to the outside.

Also, like the rotary compressor 100 of FIG. 1, oil supply may be performed through centrifugal oiling using an axial propeller. Further, in relation to oil return, the discharge chamber may be provided with first and second barrier ribs, similarly to the rotary compressor 100 of FIG. 1. Furthermore, oil in a sealing portion of the main bearing 231 and oil accumulated in the discharge chamber may be returned to a back pressure pocket.

In relation to FIG. 8, components not described will be understood by the description given with reference to FIGS. 1 to 7, and repetitive disclosure has been omitted.

Figure 9:
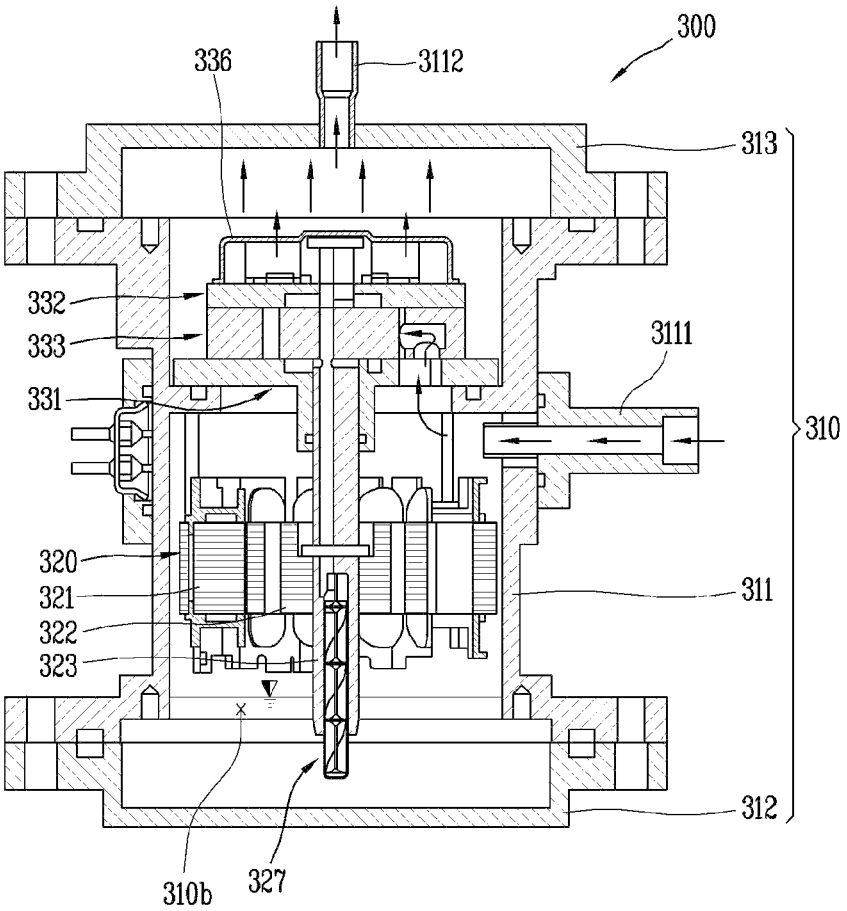
FIG. 9 is a longitudinal cross-sectional view illustrating a rotary compressor according to still another embodiment.

FIG. 9 is a longitudinal cross-sectional view of a rotary compressor according to still another embodiment.

Hereinafter, a rotary compressor according to still another embodiment will be described, with reference to FIG. 9.

As illustrated in FIG. 9, rotary compressor 300 of FIG. 9 may include a casing 310, a drive motor 320, and a compression unit. The casing 310 may include an intermediate shell 311 having a cylindrical shape, a lower shell 312 that covers a lower end of the intermediate shell 311, and an upper shell 313 that covers an upper end of the intermediate shell 311.

The drive motor 320 constitutes a motor unit that supplies power to cause the compression unit 330 to be driven. The drive motor 320 may include a stator 321, a rotor 322, and a rotational shaft 323.

Like the rotary compressor 100 described above in FIG. 1, for example, the rotary compressor 300 of FIG. 9 is configured such that the compression unit includes a cylinder 333, a roller, a main bearing 331, and a sub bearing 332. The cylinder 333 has an inner circumferential surface in an annular shape to define a compression space. The roller is rotatably disposed in the compression space of the cylinder 333, and vanes are slidably inserted into vane slots disposed at predetermined intervals along an outer circumferential surface of the roller.

The main bearing 331 and the sub bearing 332 are disposed on both upper and lower sides of the cylinder 333, respectively, to define the compression space together with the cylinder 333. The roller is rotatably disposed in the compression space. The plurality of vanes is brought into contact with an inner circumference of the cylinder 333 to partition the compression space into a plurality of compression chambers.

In the rotary compressor 300 of FIG. 9, in relation to pressure separation, a drive motor 320 is disposed at the bottom. In addition, refrigerant is supplied from the outside of the compressor into an inner space of a casing 310 through a suction tube 3111. A discharge chamber defined in the sub bearing 332 to which compressed refrigerant is supplied is formed as a high-pressure space, and a lower space of a compression unit, an oil storage space, for example, within the casing 310 are formed as a low-pressure space. A discharge tube 3112 is coupled to the upper shell 313 so that discharged refrigerant exhausts to the outside.

Also, like the rotary compressor 100 of FIG. 1, oil supply may be performed through centrifugal oiling using an axial propeller. Further, in relation to oil return, the discharge chamber may be provided with first and second barrier ribs, similarly to the rotary compressor 100 of FIG. 1. Oil accumulated in the discharge chamber of the main bearing 331 and accumulated oil in a high-pressure side may be supplied by differential pressure to a back pressure pocket.

In relation to FIG. 9, components not described will be understood by the description given with reference to FIGS. 1 to 7, and repetitive disclosure has been omitted.

In a rotary compressor according to embodiments disclosed herein, an intermediate back pressure structure adaptive to discharge pressure is improved to an intermediate back pressure structure adaptive to pressure of a compression chamber, thereby improving a contact friction loss and wear reliability with respect to a front end of a vane. Further, in a rotary compressor according to embodiments disclosed herein, when a discharge chamber is formed as a small space, the flow of oil is restricted by a second barrier rib, resulting in suppressing or preventing oil from being discharged to outside together with refrigerant and allowing a smooth oil return.

Furthermore, in a rotary compressor according to embodiments disclosed herein, oil may be separated while passing to an opposite space via a barrier rib, which may result in smooth discharge of refrigerant. In addition, an oil storage space and a sub bearing may be separated by a sub bearing cover, thereby minimizing interference between the oil storage space and the sub bearing.

A first barrier rib and a second barrier rib may form a symmetrical structure on different surfaces. This may secure a longer length of a passage along which refrigerant and oil flow within a discharge chamber, and allow refrigerant separated from oil to be discharged by the first and second barrier ribs.

According to embodiments disclosed herein, a suction port is disposed in an upper surface of a main bearing and an oil sump space is defined to communicate with the suction port. This may constitute a structure capable of guiding oil to flow into a compression chamber while refrigerant is suctioned into a cylinder, and allow the oil introduced into the compression chamber to be separated during a discharge process. In particular, as the oil sump space is formed in a circumferential direction, the oil may not flow into the compression chamber too quickly and may be delayed for a predetermined time.

According to embodiments disclosed herein, by a structure of an oil exhaust passage, an additional space may be defined in a discharge chamber and an amount of oil, which has been accumulated and then moves toward a barrier rib at the moment when high-pressure gas is discharged from a compression space, may be minimized. That is, when the high-pressure gas is discharged, the oil exhaust passage serves as a damper, and a predetermined amount or more of oil exhausts into an oil storage space through a gap between an outer circumference of a sub bearing and a casing.

The rotary compressor 100, 200, 300 is not limited to the configuration and the method of the embodiments described above, but the embodiments may be configured such that all or some of the embodiments are selectively combined so that various modifications can be made.

Embodiments disclosed herein provide a rotary compressor having a structure capable of overcoming a disadvantage of a low oil circulation rate while employing a low-pressure structure. Embodiments disclosed herein further provide a rotary compressor having a structure in which a valve for returning oil is not installed in a suction passage or a discharge passage. Embodiments disclosed herein furthermore provide a rotary compressor having a structure capable of returning oil while replacing the use of a valve, by employing a low-pressure structure and defining a collision passage.

Embodiments disclosed herein also provide a rotary compressor having a structure capable of improving an oil circulation rate while suppressing or preventing interference with an oil surface, which has been caused in the related art due to a baffle discharge port or a discharge tube disposed adjacent to an oil sump, at the beginning of operation or under specific operating conditions. Embodiments disclosed herein provide a rotary compressor having a structure capable of returning oil that may be accumulated in a low-pressure side when oil escaped to outside of the compressor is suctioned back again after circulating through an entire line.

Embodiments disclosed herein provide a rotary compressor that may include casing, a roller rotatably disposed in the compression chamber of the cylinder, a rotational shaft coupled to an inner circumference of the roller to apply a rotational force to the roller, main and sub bearings disposed on both ends of the cylinder and coupled to an outer circumference of the rotational shaft to be spaced apart from each other so as to define both surfaces of the compression space, and a sub bearing cover coupled to the sub bearing to cover one end of the sub bearing and defining a discharge chamber with the sub bearing to communicate with the compression space so as to accommodate compressed refrigerant to be discharged. The sub bearing or the sub bearing cover may include a first barrier rib that protrudes from one surface thereof located within the discharge chamber, and the first barrier rib may be spaced apart from a surface opposite to the one surface within the discharge chamber by a predetermined distance. With this configuration, a flow of oil within the discharge chamber may be restricted by the first barrier rib. This may result in suppressing or preventing oil from being discharged to outside together with refrigerant and allowing smooth return of the oil.

The first barrier rib may be disposed on the sub bearing cover. The sub bearing may include a second barrier rib that protrudes from a surface thereof opposite to the one surface where the first barrier rib is disposed within the discharge chamber, and the second barrier rib may be spaced apart from the sub bearing cover by a predetermined distance. With this configuration, oil may be separated while passing to an opposite space via a barrier rib, which may result in smooth discharge of refrigerant.

In addition, an oil storage space and the sub bearing may be separated by the sub bearing cover, thereby minimizing interference between the oil storage space and the sub bearing. The second barrier rib and the first barrier rib may form a symmetrical structure on different surfaces. This may secure a longer length of a passage along which refrigerant and oil flow within a discharge chamber, and allow refrigerant separated from oil to be discharged by the first and second barrier ribs.

The first barrier rib may come into contact with two points on an inner circumferential surface of the sub bearing. Similarly, the second barrier rib may come into contact with two points on the inner circumferential surface of the sub bearing.

Each of first and second barrier ribs may be formed to come into contact with two points on the inner circumferential surface of the sub bearing so as to restrict the flow of refrigerant and oil in a lateral direction of the first and second barrier ribs, and secure a longer passage along which the refrigerant and oil flow within the discharge chamber. Accordingly, the refrigerant separated from the oil by the first and second barrier ribs can be discharged.

The sub bearing may include a sub inlet hole formed in one or a first side thereof between the compression space and the discharge chamber, and a discharge tube disposed through another or a second side thereof such that the compressed refrigerant is discharged to the outside. The first and second barrier ribs may be disposed between the sub inlet hole and the discharge tube.

According to embodiments disclosed herein, the main bearing may include a suction port formed therethrough in a vertical direction and communicating with the compression space such that refrigerant introduced into the compressor is suctioned, and the main bearing may include an oil sump space formed in an upper surface thereof to communicate with the suction port. The oil sump space may extend in a circumferential direction. With this configuration, structure capable of guiding oil to flow into a compression chamber while refrigerant is suctioned into the cylinder may be constituted, and the oil introduced into the compression chamber may be separated during a discharge process. In particular, as the oil sump space is formed in a circumferential direction, oil may not flow into the compression chamber too quickly and may be delayed for a predetermined time.

The sub bearing may have an oil communication passage that communicates between the discharge chamber and a bottom of the cylinder such that oil within the discharge chamber is discharged therethrough, and the cylinder may include an oil exhaust space that communicates with the oil communication passage to accommodate oil, and an oil supply passage that provides communication between the oil exhaust space and an outer circumference of the cylinder such that oil within the oil exhaust space is discharged. The oil communication passage may include a first passage that communicates with a side portion of the discharge chamber in a lateral direction such that oil flows in the lateral direction, and a second passage that extends upward from the first passage and communicates with the oil exhaust space.

With this structure, an additional space may be defined in the discharge chamber and an amount of oil, which has been accumulated and then moves toward the barrier rib at the moment when high-pressure gas is discharged from the compression space, may be minimized. That is, when the high-pressure gas is discharged, the oil exhaust passage serves as a damper, and a predetermined amount or more of oil exhausts into the oil storage space through a gap between the outer circumference of the sub bearing and the casing.

The sub bearing may include an oil exhaust passage formed through between a side portion of the discharge chamber and an outer circumference of the sub bearing. The oil exhaust passage may be formed through the side portion of the discharge chamber to be in parallel in a lateral direction. For example, the oil exhaust passage may be formed in a shape bent at least twice from the side portion of the discharge chamber to the outer circumference of the sub bearing.

The oil exhaust passage may include a first exhaust passage that communicates with the side portion of the discharge chamber and formed in a lateral direction, a second exhaust passage having one end that communicates with the outer circumference of the sub bearing to be in parallel with the first exhaust passage, and a third exhaust passage formed in a vertical direction to communicate between the first and second exhaust passages. With such a structure of the oil exhaust passage, an additional space may be defined in the discharge chamber and an amount of oil, which has been accumulated and then moves toward the barrier rib at the moment when high-pressure gas is discharged from the compression space, may be minimized. That is, when the high-pressure gas is discharged, the oil exhaust passage serves as a damper, and a predetermined amount or more of oil exhausts into an oil storage space through a gap between the outer circumference of the sub bearing and the casing.

The main bearing may include a sealing portion that faces an outer circumference of the rotational shaft to seal a gap between the main bearing and the outer circumference of the rotational shaft so as to restrict a flow of oil, and an oil guide passage that communicates between the sealing portion and an outer circumference of the main bearing and guiding discharge of oil accumulated in the sealing portion.

The oil guide passage may provide communication between the sealing portion and the outer circumference of the main bearing to be at least partially inclined downward.

The oil guide passage may include a first guide passage having one side that communicates with the sealing portion and inclined downward toward the outer circumference of the main bearing, and a second guide passage that communicates between the first guide passage and the outer circumference of the main bearing. The second guide passage may be formed parallel to a lateral direction in a bottom of the main bearing. With this structure of the oil guide passage, oil in the sealed portion of the main bearing exhausts into the oil storage space through a gap between the outer circumference of the main bearing and the casing.

The casing may include a suction tube coupled thereto to allow refrigerant to flow into the casing, and a discharge tube that communicates with the discharge chamber to allow compressed refrigerant to be discharged to outside, and the discharge tube may be located lower than the suction tube.

It will be apparent to those skilled in the art that embodiments may be embodied in other specific forms without departing from the spirit or essential characteristics thereof. The above detailed description should not be limitedly construed in all aspects and should be considered as illustrative. Therefore, all changes and modifications that fall within the metes and bounds of the claims, or equivalents of such metes and bounds are therefore intended to be embraced by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a casing;

a cylinder disposed inside of the casing and having an inner circumferential surface formed in an annular shape to define a compression space;

a roller rotatably disposed in the compression space of the cylinder;

a rotational shaft coupled to an inner circumference of the roller to apply a rotational force to the roller;

a main bearing and a sub bearing disposed on both ends of the cylinder, respectively, coupled to an outer circumference of the rotational shaft, and spaced apart from each other to define the compression space; and a sub bearing cover coupled to the sub bearing to cover one end of the sub bearing and defining a discharge chamber with the sub bearing to communicate with the compression space so as to accommodate compressed refrigerant to be discharged, wherein the sub bearing or the sub bearing cover includes a first barrier rib that protrudes from a surface of the sub bearing or the sub bearing cover located inside of the discharge chamber, wherein the first barrier rib of the sub bearing or the sub bearing cover is spaced apart from a surface opposite to the surface within the discharge chamber by a predetermined distance, and wherein the first barrier rib of the sub bearing or the sub bearing cover is a plate-shaped rib that extends linearly in a radial direction of the sub bearing or the sub bearing cover.

2. The rotary compressor of claim 1, wherein the first barrier rib is disposed on the sub bearing cover, wherein the sub bearing includes a second barrier rib that protrudes from a surface thereof opposite to the surface where the first barrier rib is disposed within the discharge chamber, and wherein the second barrier rib is spaced apart from the sub bearing cover by a predetermined distance.

3. The rotary compressor of claim 2, wherein the second barrier rib comes into contact with two points on an inner circumferential surface of the sub bearing.

4. The rotary compressor of claim 2, wherein the sub bearing includes a sub inlet hole formed through a first side thereof between the compression space and the discharge chamber, and a discharge tube disposed through a second side thereof such that the compressed refrigerant is discharged to an outside of the casing, and wherein the first barrier rib and the second barrier rib are disposed between the sub inlet hole and the discharge tube.

5. The rotary compressor of claim 1, wherein the first barrier rib of the sub bearing or the sub bearing cover comes into contact with two points on an inner circumferential surface of the sub bearing.

6. The rotary compressor of claim 1, wherein the main bearing includes a suction port formed therethrough in a vertical direction, the suction port communicating with the compression space such that refrigerant introduced into the compressor is suctioned, and wherein the main bearing includes an oil sump space formed at an upper surface thereof to communicate with the suction port.

7. The rotary compressor of claim 6, wherein the oil sump space extends in a circumferential direction.

8. The rotary compressor of claim 1, wherein the sub bearing has an oil communication passage that provides communication between the discharge chamber and a bottom of the cylinder such that oil within the discharge chamber is discharged therethrough, and wherein the cylinder includes an oil exhaust space that communicates with the oil communication passage to accommodate oil, and an oil supply passage that provides communication between the oil exhaust space and an outer circumference of the cylinder such that oil within the oil exhaust space is discharged.

9. The rotary compressor of claim 8, wherein the oil communication passage includes:

a first passage that communicates with a side portion of the discharge chamber in a lateral direction such that oil flows in the lateral direction; and a second passage that extends upward from the first passage and communicates with the oil exhaust space.

10. The rotary compressor of claim 1, wherein the sub bearing includes an oil exhaust passage formed through between a side portion of the discharge chamber and an outer circumference of the sub bearing.

11. The rotary compressor of claim 10, wherein the oil exhaust passage is formed through the side portion of the discharge chamber and extends parallel to a lateral direction.

12. The rotary compressor of claim 10, wherein the oil exhaust passage is formed in a shape bent at least twice from the side portion of the discharge chamber to the outer circumference of the sub bearing.

13. The rotary compressor of claim 12, wherein the oil exhaust passage includes:

a first exhaust passage that communicates with the side portion of the discharge chamber and extends in a lateral direction;

a second exhaust passage, one end of which communicates with the outer circumference of the sub bearing, the second exhaust passage extending in parallel with the first exhaust passage; and a third exhaust passage formed in a vertical direction to provide communication between the first exhaust passage and the second exhaust passage.

14. The rotary compressor of claim 1, wherein the main bearing includes:

a sealing portion facing the outer circumference of the rotational shaft to seal a gap between the main bearing and the outer circumference of the rotational shaft so as to restrict a flow of oil; and an oil guide passage that provides communication between the sealing portion and an outer circumference of the main bearing and guides discharge of oil accumulated in the sealing portion.

15. The rotary compressor of claim 14, wherein the oil guide passage is at least partially inclined downward.

16. The rotary compressor of claim 14, wherein the oil guide passage includes:

a first guide passage one side of which communicates with the sealing portion and which is inclined downward toward the outer circumference of the main bearing; and a second guide passage that provides communication between the first guide passage and the outer circumference of the main bearing.

17. The rotary compressor of claim 16, wherein the second guide passage extends parallel to a lateral direction at a bottom of the main bearing.

18. The rotary compressor of claim 1, wherein the casing includes:

a suction tube coupled thereto to allow refrigerant to flow into the casing; and a discharge tube that communicates with the discharge chamber to allow compressed refrigerant to be discharged to outside, and wherein the discharge tube is located lower than the suction tube.

19. A rotary compressor, comprising:

a casing;

a cylinder disposed inside of the casing and having an inner circumferential surface formed in an annular shape to define a compression space;

a roller rotatably disposed in the compression space of the cylinder;

a rotational shaft coupled to an inner circumference of the roller to apply a rotational force to the roller;

a main bearing and a sub bearing disposed on both ends of the cylinder, respectively, coupled to an outer circumference of the rotational shaft, and spaced apart from each other to define the compression space; and a sub bearing cover coupled to the sub bearing to cover one end of the sub bearing and defining a discharge chamber with the sub bearing to communicate with the compression space so as to accommodate compressed refrigerant to be discharged, wherein the sub bearing and the sub bearing cover each includes a barrier rib that protrudes from a surface of the sub bearing and the sub bearing cover located inside of the discharge chamber, wherein the barrier rib of the sub bearing and the barrier rib of the sub bearing cover are spaced apart from a surface opposite to the surface within the discharge chamber by a predetermined distance, and wherein each of the barrier rib of the sub bearing and the barrier rib of the sub bearing cover is a plate-shaped rib that extends linearly in a radial direction of the sub bearing or the sub bearing cover.

20. The rotary compressor of claim 19, wherein the each of the barrier rib of the sub bearing and the barrier rib of the sub bearing cover comes into contact with two points on an inner circumferential surface of the sub bearing.

* * * * *